US012313256B2

(12) United States Patent
Zhou et al.

(10) Patent No.: US 12,313,256 B2
(45) Date of Patent: May 27, 2025

(54) COMBUSTION DEVICE AND COOKING APPARATUS

(71) Applicants: GUANGDONG MIDEA KITCHEN APPLIANCES MANUFACTURING CO., LTD., Foshan (CN); MIDEA GROUP CO., LTD., Foshan (CN)

(72) Inventors: Hanhua Zhou, Foshan (CN); Wang Wang, Foshan (CN); Hu Jin, Foshan (CN)

(73) Assignees: GUANGDONG MIDEA KITCHEN APPLIANCES MANUFACTURING CO., LTD., Foshan (CN); MIDEA GROUP CO., LTD., Foshan (CN)

( * ) Notice: Subject to any disclaimer, the term of this patent is extended or adjusted under 35 U.S.C. 154(b) by 920 days.

(21) Appl. No.: 17/467,273

(22) Filed: Sep. 6, 2021

(65) Prior Publication Data

US 2022/0074587 A1 Mar. 10, 2022

(30) Foreign Application Priority Data

Sep. 10, 2020 (CN) ..... 202010949647.4
Sep. 25, 2020 (CN) ..... 202011025643.3
Dec. 31, 2020 (CN) ..... 202011635524.X

(51) Int. Cl.
*F23D 14/14* (2006.01)
*F23D 14/10* (2006.01)
(Continued)

(52) U.S. Cl.
CPC ..... *F23D 14/14* (2013.01); *F23D 14/10* (2013.01); *F23D 14/84* (2013.01); *F24C 3/103* (2013.01); *F24C 3/128* (2013.01); *F24C 15/001* (2013.01)

(58) Field of Classification Search
CPC ..... F24C 3/087; F24C 3/085; F24C 3/103; F24C 3/128; F24C 15/001; F23D 14/14; F23D 14/10; F23D 14/84
(Continued)

(56) References Cited

U.S. PATENT DOCUMENTS

2004/0177840 A1* 9/2004 Brock ..... F24C 3/087 126/41 R
2013/0255660 A1* 10/2013 Han ..... F24C 3/087 126/273 R
(Continued)

FOREIGN PATENT DOCUMENTS

CN 2061425 U 9/1990
CN 102379319 A 3/2012
(Continued)

OTHER PUBLICATIONS

First OA of CN Application No. 202010949647.4.
(Continued)

*Primary Examiner* — Vivek K Shirsat

(57) ABSTRACT

The present application discloses a combustion device and a cooking apparatus. The combustion device includes a combustion assembly, the combustion assembly includes a first combustion assembly, and the first combustion assembly includes a box, a first combustor, a top plate and a fire splitting assembly. The box is provided with an opening and a set of intake holes; the first combustor is arranged in the box; the top plate is matched with the box and closes the opening, and is provided with a set of exhaust holes; and the fire splitting assembly is arranged in the box; an intake passage is formed between the fire splitting assembly and an inner bottom surface of the box, one end of the intake passage communicates with the set of intake holes.

19 Claims, 11 Drawing Sheets

(51) Int. Cl.

| | |
|---|---|
| ***F23D 14/84*** | (2006.01) |
| ***F24C 3/10*** | (2006.01) |
| ***F24C 3/12*** | (2006.01) |
| ***F24C 15/00*** | (2006.01) |

(58) Field of Classification Search
USPC ..... 431/328; 126/21 A, 21 R, 19 R, 273 R, 126/39 D, 41 R
See application file for complete search history.

(56) References Cited

U.S. PATENT DOCUMENTS

| | | | | |
|---|---|---|---|---|
| 2015/0096550 | A1* | 4/2015 | Paller | F23D 14/10 126/21 R |
| 2022/0049849 | A1* | 2/2022 | Vie | F23N 5/265 |

FOREIGN PATENT DOCUMENTS

| | | | |
|---|---|---|---|
| CN | 203634028 | U | 6/2014 |
| CN | 204100240 | U | 1/2015 |
| CN | 104748166 | A | 7/2015 |
| CN | 205053862 | U | 3/2016 |
| CN | 107940460 | A | 4/2018 |
| CN | 107975798 | A | 5/2018 |
| CN | 108343959 | A | 7/2018 |
| CN | 207693469 | U | 8/2018 |
| CN | 209165469 | U | 7/2019 |
| CN | 110207165 | A | 9/2019 |
| CN | 111035273 | A | 4/2020 |
| CN | 210398990 | U | 4/2020 |
| CN | 111503668 | A | 8/2020 |
| CN | 212178934 | U | 12/2020 |
| JP | 2000083833 | A | 3/2000 |
| JP | 2000291963 | A | 10/2000 |

OTHER PUBLICATIONS

First OA of CN Application No. 202011025643.3.
First OA Received in CN Application No. 202011635524.X; mailed Feb. 26, 2025.

* cited by examiner

COMBUSTION DEVICE AND COOKING APPARATUS

CROSS-REFERENCES TO RELATED APPLICATIONS

The present application claims benefits of Chinese Application No. 202010949647.4 filed on Sep. 10, 2020, Chinese Application No. 202011025643.3 filed on Sep. 25, 2020 and Chinese Application No. 202011635524.X filed on Dec. 31, 2020, the entireties of which are herein incorporated by reference.

FIELD

The present application relates to the field of household appliances, in particular to a combustion device and a cooking apparatus.

BACKGROUND

This section provides only background information related to the present disclosure, which is not necessarily the prior art.

A cooking apparatus (an oven or a grill, etc.) typically includes a combustion device and a cabinet with a cooking cavity. The combustion device is arranged in the cooking cavity and is communicated with gas. The combustion device is activated to combust the gas, and heating the cooking cavity.

The combustion device includes a box and a combustor. The box is provided therein with an intake passage and an exhaust passage. The combustor is arranged in the box. The gas enters the box through the combustor, and air enters the box through the intake passage. After the gas and the air are mixed and combust, a combustion exhaust gas enters the cooking cavity through the exhaust passage, and is finally discharged through a smoke discharge passage of the cooking apparatus.

In the prior art, the intake passage and the exhaust passage have structural defects, which limit the power and thermal efficiency of the combustion device.

SUMMARY

An embodiment of the present application is to at least solve the problem of how to improve the structures of the intake passage and the exhaust passage to increase the power and thermal efficiency of the combustion device. This object is achieved through the following embodiments.

One embodiment of the present application proposes a combustion device for a cooking apparatus, the combustion device including a combustion assembly, the combustion assembly including a first combustion assembly, and the first combustion assembly including:

- a box, which is provided with an opening and a set of intake holes;
- a first combustor, which is arranged in the box;
- a top plate, which is matched with the box and closes the opening, and which is provided with a set of exhaust holes; and
- a fire splitting assembly, which is arranged in the box; in which an intake passage is formed between the fire splitting assembly and an inner bottom surface of the box, one end of the intake passage communicates with the set of intake holes, and the other end of the intake passage communicates with an installation position of the first combustor; an exhaust passage is formed between the fire splitting assembly and the top plate, one end of the exhaust passage communicates with the set of exhaust holes, and the other end of the exhaust passage communicates with the installation position of the first combustor.

According to the combustion device of the present application, the top plate is matched with the opening of the box, and an interior of the box can communicate with the outside only through the set of intake holes and the set of exhaust holes. The fire splitting assembly is arranged in the box, the fire splitting assembly and the top plate form the exhaust passage that communicates with the set of exhaust holes, and the fire splitting assembly and the inner bottom surface of the box form the intake passage that communicates with the set of intake holes. The first combustor is arranged in the box and located between the intake passage and the exhaust passage. When the first combustor is used to heat the cooking apparatus, the air reaches the installation position of the first combustor through the set of intake holes and the intake passage, and the gas enters the box through the first combustor and mixes with the air. After the combustible gas is ignited, combusting flames extend along the fire splitting assembly, and the heat generated after the combustion is radiated into the cooking cavity through the top plate. The combustion exhaust gas enters the cooking cavity through the exhaust passage and the set of exhaust holes, and then is discharged through a smoke discharge passage of the cooking apparatus. The intake passage and exhaust passage are arranged on both sides of the fire splitting assembly, and the intake passage is located at a bottom of the exhaust passage. The intake process is smooth and sufficient air can be provided to the first combustor so that the air-fuel ratio is increased, and improving the power of the combustion device. In addition, the exhaust passage is located at an upper part of the intake passage, which facilitates the discharge of combustion exhaust gas, so that the gas can fully combust, the amount of smoke generated is reduced, and the thermal efficiency of the combustion device is improved.

In addition, the combustion device according to the present application may also have the following additional embodiments.

In some embodiments of the present application, the set of intake holes include a first intake hole, the set of exhaust holes include a first exhaust hole, and the fire splitting assembly includes a first fire splitting plate; in which the first fire splitting plate, the first exhaust hole and the first intake hole are all located on one side of the first combustor; a first passage portion of the exhaust passage is formed between the first fire splitting plate and the top plate; both ends of the first passage portion communicate with the first exhaust hole and the installation position of the first combustor respectively; a first passage section of the intake passage is formed between the first fire splitting plate and the inner bottom surface of the box, and both ends of the first passage section communicate with the first intake hole and the installation position of the first combustor respectively.

In some embodiments of the present application, the first fire splitting plate includes:

- a first plate body portion, which is arranged spaced apart from the inner bottom surface of the box, in which one end of the first plate body portion abuts against the top plate, and the other end of the first plate body portion extends toward the installation position of the first combustor; and a first support portion, in which the first plate body portion is matched with the inner bottom surface of the box through the first support portion.

In some embodiments of the present application, an edge of the first plate body portion abuts against a side wall of the box; and/or the first plate body portion is of a first bend structure.

In some embodiments of the present application, the first exhaust hole is a first elongated hole, and the first elongated hole extends in a length direction of the first combustor; and/or the number of the first intake holes is plural, and each of the first intake holes is provided on a side wall of the box and/or the inner bottom surface of the box.

In some embodiments of the present application, the set of intake holes include a second intake hole, the set of exhaust holes include a second exhaust hole, and the fire splitting assembly includes a second fire splitting plate; in which the second fire splitting plate, the second exhaust hole and the second intake hole are all located on the other side of the first combustor; a second passage portion of the exhaust passage is formed between the second fire splitting plate and the top plate; both ends of the second passage portion communicate with the second exhaust hole and the installation position of the first combustor respectively; a second passage section of the intake passage is formed between the second fire splitting plate and the inner bottom surface of the box, and both ends of the second passage section communicate with the second intake hole and the installation position of the first combustor respectively.

In some embodiments of the present application, the second fire splitting plate includes:

a second plate body portion, which is arranged spaced apart from the inner bottom surface of the box, in which one end of the second plate body portion abuts against the top plate, and the other end of the second plate body portion extends toward the installation position of the first combustor; and a second support portion, in which the second plate body portion is matched with the inner bottom surface of the box through the second support portion.

In some embodiments of the present application, an edge of the second plate body portion abuts against a side wall of the box; and/or the second plate body portion is of a second bend structure.

In some embodiments of the present application, the second exhaust hole is a second elongated hole, and the second elongated hole extends in a length direction of the first combustor; and/or the number of the second intake holes is plural, and each of the second intake holes is provided on a side wall of the box and/or the inner bottom surface of the box.

In some embodiments of the present application, the combustion assembly further includes a second combustion assembly, and the second combustion assembly includes:

a second combustor, which is arranged in a cooking cavity of the cooking apparatus and is configured to heat the cooking cavity; and a radiation plate, which is arranged between the second combustor and a top plate of the cooking cavity; in which the radiation plate is a bend plate and extends in a length direction of the cooking cavity, and flames of the second combustor flow along a side surface of the radiation plate that is away from the top plate of the cooking cavity.

In some embodiments of the present application, the radiation plate includes:

a main plate body, which is arranged spaced apart from the top plate of the cooking cavity; in which the second combustor is located on a side of the main plate body that is away from the top plate of the cooking cavity and is matched with the main plate body;

a first plate body, which is of a first bend structure and is connected to one side of the main plate body; and a second plate body, which is of a second bend structure and is connected to the other side of the main plate body.

In some embodiments of the present application, the first plate body includes:

a first portion, which is connected to the one side of the main plate body and is arranged in a direction approaching the top plate of the cooking cavity; and a second portion, which is connected to the first portion and bends in a direction away from the top plate of the cooking cavity.

In some embodiments of the present application, a first connection structure is provided on the second portion, and the first connection structure is configured to connect with the top plate of the cooking cavity.

In some embodiments of the present application, the number of the first connection structures is plural, and the first connection structures are arranged spaced apart on the second portion; and/or an edge of the second portion that is away from the first portion is provided with a first cut toward an inner side of the second portion, and materials removed at the position of the first cut bend in the direction approaching the top plate of the cooking cavity to form the first connection structure; and/or a first corner position of the second portion is provided with a first round chamfer, and the first corner position is away from the first portion and close to an open end of the cooking cavity.

In some embodiments of the present application, the second plate body includes:

a third portion, which is connected to the other side of the main plate body and is arranged in a direction approaching the top plate of the cooking cavity; and a fourth portion, which is connected to the third portion and bends in a direction away from the top plate of the cooking cavity.

In some embodiments of the present application, a second connection structure is provided on the fourth portion, and the second connection structure is configured to connect with the top plate of the cooking cavity.

In some embodiments of the present application, the number of the second connection structures is plural, and the second connection structures are arranged spaced apart on the fourth portion; and/or an edge of the fourth portion that is away from the third portion is provided with a second cut toward an inner side of the fourth portion, and materials removed at the position of the second cut bend in the direction approaching the top plate of the cooking cavity to form the second connection structure; and/or a second corner position of the fourth portion is provided with a second round chamfer, and the second corner position is away from the third portion and close to an open end of the cooking cavity.

In some embodiments of the present application, an installation groove is provided on the main plate body, an installation structure is provided on the second combustor, and the installation structure is adapted to be installed in the installation groove; and/or the combustion assembly further includes fasteners, and the second combustor is connected to the main plate body through the fasteners.

In some embodiments of the present application, the combustion device further includes a combustion inductor arranged on the combustion assembly, and the combustion inductor includes an inductor body and a wiring terminal that are detachably connected.

In some embodiments of the present application, the inductor body is arranged at one end of the combustion assembly, and the wiring terminal is arranged at one end of the inductor body that is away from the combustion assembly.

In some embodiments of the present application, a part of the wiring terminal that is close to the inductor body is provided with a snap-fit structure, and the snap-fit structure is snap-fitted with the inductor body so that the snap-fit structure and the inductor body are electrically conducted with each other.

In some embodiments of the present application, a wiring hole is provided at one end of the wiring terminal that is away from the inductor body.

In some embodiments of the present application, at least part of an outer surface of the wiring terminal is provided with an insulating layer.

In some embodiments of the present application, at least part of the inductor body is of a rod-shaped structure.

In some embodiments of the present application, an induction probe is provided at one end of the inductor body that faces the combustion assembly.

In some embodiments of the present application, the combustion inductor further includes a connection bracket, the connection bracket is connected to the inductor body, and the connection bracket protrudes outward in a radial direction of the inductor body and is configured to connect with the combustion assembly.

In some embodiments of the present application, a strength of the wiring terminal is greater than a strength of the inductor body.

In some embodiments of the present application, the combustion inductor is arranged on a fire row of the second combustor at a position near an intake end, and the combustion inductor is arranged in an axial direction of the fire row.

In some embodiments of the present application, the combustion assembly further includes a fixing bracket connected to the fire row at a position near the intake end, the fixing bracket is provided with a first installation plate, and the first installation plate extends toward one side in a radial direction of the fire row; in which a third connection structure is provided on the first installation plate, and the combustion inductor is detachably connected to the first installation plate through the third connection structure.

In some embodiments of the present application, the third connection structure is arranged toward the axial direction of the fire row.

In some embodiments of the present application, a second installation plate is provided on a side of the fixing bracket that is opposite to the first installation plate, and the second installation plate is provided with a fourth connection structure for connecting with an igniter.

In some embodiments of the present application, the combustion inductor is an ion inductor.

Another embodiment of the present application proposes a cooking apparatus, which includes:

a cabinet, which is provided with a cooking cavity;

a door, which is pivotally connected to the cabinet to open or close the cooking cavity;

a combustion device, which is the combustion device as described above; in which the combustion device is arranged in the cooking cavity and is configured to heat the cooking cavity, and an axial direction of the combustion assembly of the combustion device is opposite to the door;

an igniter, which is detachably connected to the combustion assembly; and an electronic control assembly, which is electrically connected to a combustion inductor of the combustion device and the igniter, respectively.

BRIEF DESCRIPTION OF THE DRAWINGS

The drawings are only used for the purpose of illustrating the embodiments, and should not be considered as a limitation to the present application. Moreover, throughout the drawings, identical components are denoted by identical reference signs. In the drawings.

LIST OF REFERENCE SIGNS

Figure 1:
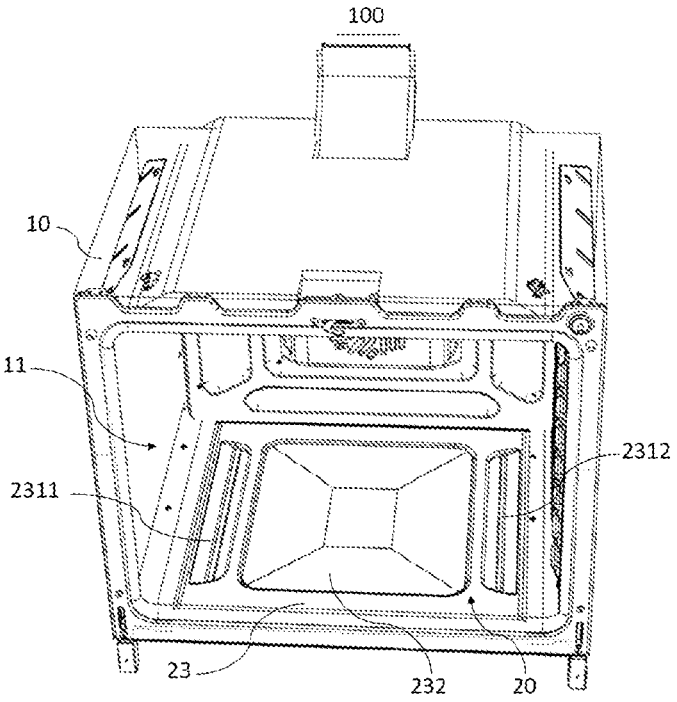
FIG. 1 schematically shows a schematic structural view (partial structure) of a cooking apparatus according to an embodiment of the present application.
Figure 2:
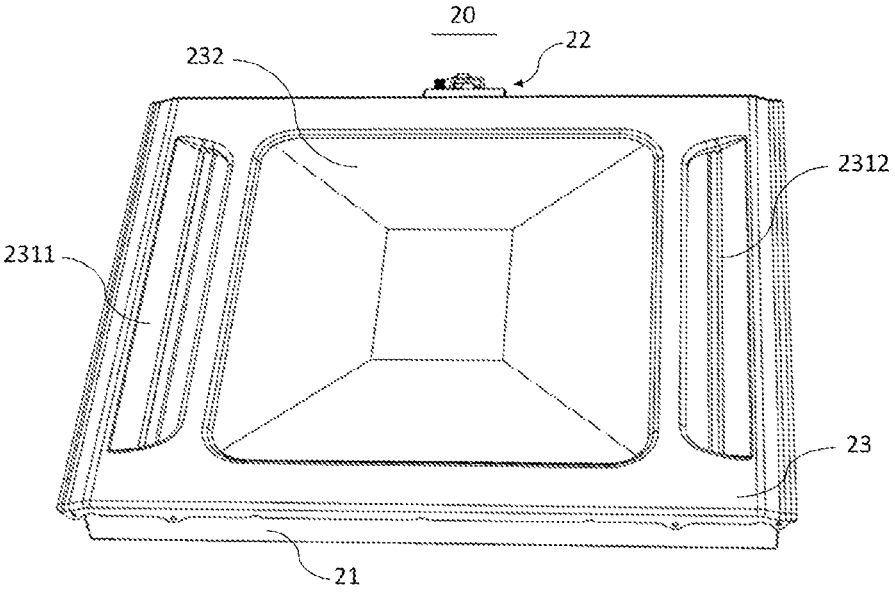
FIG. 2 is a schematic structural view of a first combustion assembly of a combustion device of the cooking apparatus shown in FIG. 1.

100: cooking apparatus;

10: cabinet; 11: cooking cavity; 12: top plate of the cooking cavity;

1: combustion device;

20: first combustion assembly;

21: box; 211: a set of intake holes; 2111: first intake hole; 2112: second intake hole; 212: opening;

22: first combustor;

23: top plate; 231: a set of exhaust holes; 2311: first exhaust hole; 2312: second exhaust hole; 232: oil collecting groove;

24: fire splitting assembly; 241: first fire splitting plate; 2411: first plate body portion; 2412: first support portion; 242: second fire splitting plate; 2421: second plate body portion; 2422: second support portion;

25: intake passage; 251: first passage section; 252: second passage section; 26: exhaust passage; 261: first passage portion; 262: second passage portion;

30: second combustion assembly;

31: second combustor;

311 intake end; 312: fixing bracket; 313: first installation plate; 314: third connection structure; 315: second installation plate; 316: fourth connection structure;

32: radiation plate;

321: main plate body; 3211: installation groove; 3212: connection hole;

322: first plate body; 3221: first portion; 3222: second portion; 32221: first cut; 32222: first round chamfer; 32223: first connection structure;

323: second plate body; 3231: third portion; 3232: fourth portion; 32321: second cut; 32322: second round chamfer; 32323: second connection structure;

40: combustion inductor;

41: inductor body; 411: induction probe; 42: wiring terminal; 421: snap-fit structure; 422: wiring hole; 43: connection bracket;

50: door;

60: igniter;

70: electronic control assembly.

DETAILED DESCRIPTION OF THE DISCLOSURE

Hereinafter, exemplary embodiments of the present disclosure will be described in greater detail with reference to the accompanying drawings. Although the exemplary embodiments of the present disclosure are shown in the drawings, it should be understood that the present disclosure may be implemented in various forms and should not be limited by the embodiments set forth herein.

It should be understood that the terms used herein are only for the purpose of describing specific exemplary embodiments, and are not intended to be limitative. Unless clearly indicated otherwise in the context, singular forms "a", "an", and "said" as used herein may also mean that the plural form is included. Terms "include", "comprise", "contain" and "have" are inclusive and therefore indicate the existence of the stated features, steps, operations, elements and/or components, but do not exclude the existence or addition of one or more other features, steps, operations, elements, components, and/or combinations thereof. The method steps, processes, and operations described herein should not be interpreted as requiring them to be executed in the specific order described or illustrated, unless the order of execution is clearly indicated. It should also be understood that additional or alternative steps may be used.

Although terms "first", "second", "third" and the like may be used herein to describe multiple elements, components, regions, layers and/or sections, these elements, components, regions, layers and/or sections should not be limited by these terms. These terms may only be used to distinguish one element, component, region, layer or section from another region, layer or section. Unless clearly indicated in the context, terms such as "first", "second" and other numerical terms do not imply an order or sequence when they are used herein. Therefore, the first element, component, region, layer or section discussed below may be referred to as a second element, component, region, layer or section without departing from the teachings of the exemplary embodiments.

For ease of description, spatial relative terms may be used herein to describe the relationship of one element or feature relative to another element or feature as shown in the drawings. These relative terms are, for example, "inner", "outer", "inside", "outside", "below", "under", "above", "over", etc. These spatial relative terms are intended to include different orientations of the device in use or operation in addition to the orientation depicted in the drawings. For example, if the device in the figure is turned over, then elements described as "below other elements or features" or "under other elements or features" will be oriented as "above the other elements or features" or "over the other elements or features". Thus, the exemplary term "below" may include orientations of both above and below. The device can be otherwise oriented (rotated by 90 degrees or in other directions), and the spatial relationship descriptors used herein will be explained accordingly.

As shown in FIGS. 1 to 7, according to an embodiment of the present application, a combustion device 1 is proposed, which is used in a cooking apparatus 100; the combustion device 1 includes a combustion assembly, and the combustion assembly includes a first combustion assembly 20; the first combustion assembly 20 includes a box 21, a first combustor 22, a top plate 23 and a fire splitting assembly 24; the box 21 is provided with an opening 212 and a set of intake holes 211; the first combustor 22 is arranged in the box 21, the top plate 23 is matched with the box 21 and closes the opening 212; the top plate 23 is provided with a set of exhaust holes 231, the fire splitting assembly 24 is arranged in the box 21, and an intake passage 25 is formed between the fire splitting assembly 24 and an inner bottom surface of the box 21; one end of the intake passage 25 communicates with the set of intake holes 211, and the other end of the intake passage 25 communicates with an installation position of the first combustor 22; an exhaust passage 26 is formed between the fire splitting assembly 24 and the top plate 23, one end of the exhaust passage 26 communicates with the set of exhaust holes 231, and the other end of the exhaust passage 26 communicates with the installation position of the first combustor 22.

In one embodiment, the top plate 23 is matched with the opening 212 of the box 21. An interior of the box 21 can communicate with the outside only through the set of intake holes 211 and the set of exhaust holes 231. The fire splitting assembly 24 is arranged in the box 21. The fire splitting assembly 24 and the top plate 23 form the exhaust passage 26 communicating with the set of exhaust holes 231. The fire splitting assembly 24 and the inner bottom surface of the box 21 form the intake passage 25 communicating with the set of intake holes 211. The first combustor 22 is arranged in the box 21 and is located between the intake passage 25 and the exhaust passage 26. When the first combustor 22 is used to heat the cooking apparatus 100, the air reaches the installation position of the first combustor 22 through the set of intake holes 211 and the intake passage 25, and the gas enters the box 21 through the first combustor 22 and is mixed with the air. After the combustible gas is ignited, combusting flames extend along the fire splitting assembly 24, and the heat generated after the combustion is radiated into the cooking cavity 11 through the top plate 23. The combustion exhaust gas enters the cooking cavity 11 through the exhaust passage 26 and the set of exhaust holes 231, and then is discharged through a smoke discharge passage of the cooking apparatus 100. The intake passage 25 and the exhaust passage 26 are arranged on both sides of the fire splitting assembly, and the intake passage 25 is located at a bottom of the exhaust passage 26. The intake process is smooth, and sufficient air can be provided to the first combustor 22 so that the air-fuel ratio is increased, and improving the power of the combustion device 1. In addition, the exhaust passage 26 is located at an upper part of the intake passage 25, which facilitates the discharge of the combustion exhaust gas, so that the gas can fully combust, the amount of smoke generated is reduced, and the thermal efficiency of the combustion device 1 is improved.

It should be understood that since the gas can fully combust, less smoke enters the cooking cavity 11, and avoiding the occurrence of carbon deposition in the cooking cavity 11, meeting the market's requirements on the cooking apparatus 100, and facilitating the promotion and popularization of the cooking apparatus 100.

It should be pointed out that the first combustor 22 is arranged in the box 21 and is located between the top plate 23 and the inner bottom surface of the box 21, the first combustor 22 is located in a middle position of the box 21, and the fire splitting assembly 24 is arranged between the top plate 23 and the inner bottom surface of the box 21, so that the intake passage 25 is located at the bottom of the first combustor 22, and the exhaust passage 26 is located at an upper part of the first combustor 22. Since both the air and the gas have a lift force, the air and the gas are mixed and combust at the position of the first combustor 22 so that sufficient combustion of the gas can be ensured. The generated combustion exhaust gas is discharged through the exhaust passage 26 and the set of exhaust holes 231 after ascending, so that the combustion exhaust gas can be fully discharged, the influence of the combustion exhaust gas on the first combustor 22 is avoided, and the combustion efficiency of the gas is improved.

In addition, an oil collecting groove 232 is provided on a top surface of the top plate 23 (a side surface away from the box 21). When the combustion device 1 is used to heat the cooking apparatus 100, the combustion device 1 is arranged at the bottom of the cooking cavity 11, and when the combustion device 1 is heating the cooking cavity 11, the top plate 23 has an ability to radiate heat into the cooking cavity 11. Since the top surface of the top plate 23 has the oil collecting groove 232, the area of the top plate 23 is increased, and at the same time, since it has a different angled side surface, the heat radiation ability of the top plate 23 is improved, so that the heating in the cooking cavity 11 is more uniform. In addition, liquid substances such as grease generated during the cooking process are collected in the oil collecting groove 232, which is easy to clean, and ensuring that the cooking cavity 11 has good sanitary conditions.

It is further understood that as shown in FIGS. 3 to 6, the set of intake holes 211 include a first intake hole 2111, the set of exhaust holes 231 include a first exhaust hole 2311, and the fire splitting assembly 24 includes a first fire splitting plate 241. The first fire splitting plate 241, the first exhaust hole 2311 and the first intake hole 2111 are all located on one side of the first combustor 22, and a first passage portion 261 of the exhaust passage 26 is formed between the first fire splitting plate 241 and the top plate 23. Two ends of the first passage portion 261 communicate with the first exhaust hole 2311 and the installation position of the first combustor 22 respectively. A first passage section 251 of the intake passage 25 is formed between the first fire splitting plate 241 and the inner bottom surface of the box 21, and two ends of the first passage section 251 communicate with the first intake hole 2111 and the installation position of the first combustor 22 respectively. In one embodiment, the first combustor 22 is arranged in the box 21, the first fire splitting plate 241 is arranged on one side of the first combustor 22, and one side surface of the first fire splitting plate 241 and the inner bottom surface of the box 21 form the first passage portion 261 of the intake passage 25; the other side surface of the first fire splitting plate 241 and the top plate 23 form the first passage section 251 of the exhaust passage 26, and the installation position of the first combustor 22 is located at a position where the first passage section 251 communicates with the first passage portion 261, that is, the first passage portion 261 and the first passage section 251 form a first bend structure, and the first combustor 22 is arranged at the bend position. Air enters the first passage section 251 through the first intake hole 2111. When the air reaches the bend position, the air is mixed with the gas released by the first combustor 22, the gas is ignited, and the smoke generated after combustion enters the first passage portion 261 and finally enters the cooking cavity 11 through the first exhaust hole 2311. The first passage section 251 and the first passage portion 261 are separated by the first fire splitting plate 241, and the first passage section 251 is located at the bottom of the first passage portion 261, which further improves the air-fuel ratio and avoids the influence of the combustion exhaust gas on gas combustion, and increasing the power and thermal efficiency of the combustion device 1.

Figure 3:
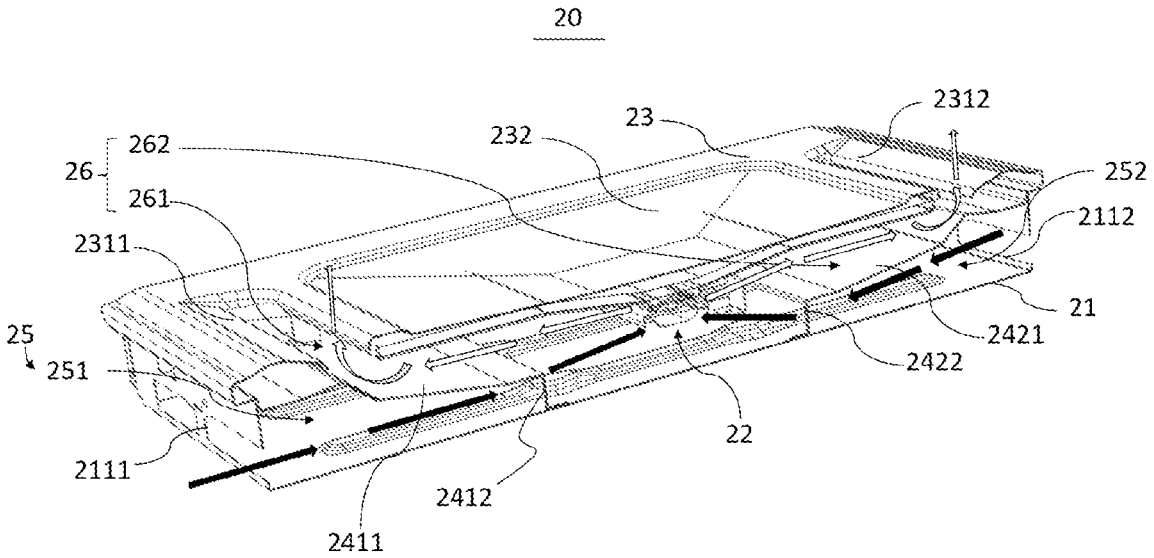
FIG. 3 is a sectional view of the first combustion assembly shown in FIG. 2 (in which black solid arrows in the figure indicate a flow direction of air, and black hollow arrows in the figure indicate a flow direction of combustion exhaust gas)
Figure 4:
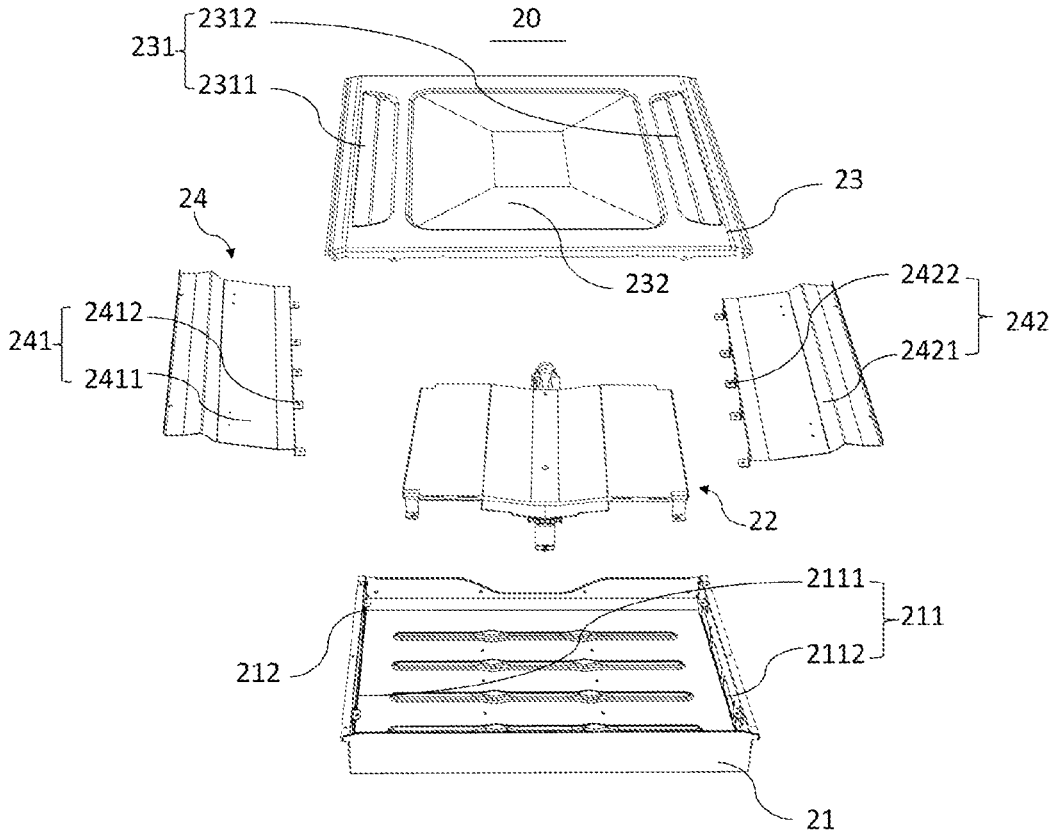
FIG. 4 is a schematic view of an exploded structure of the first combustion assembly shown in FIG. 2.
Figure 6:
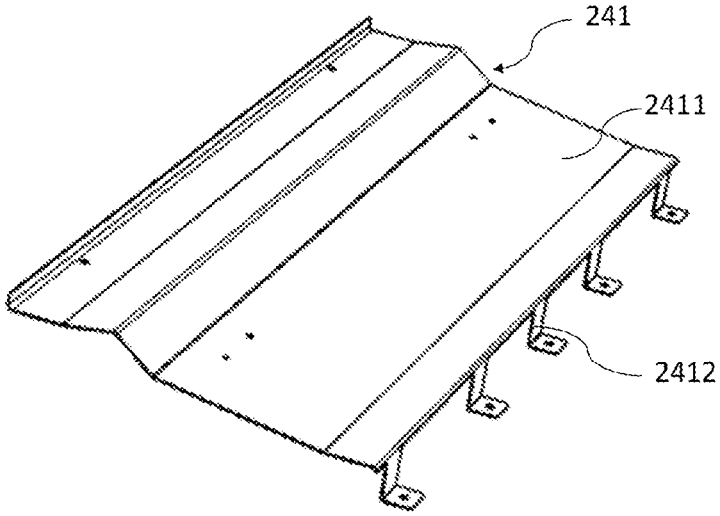
FIG. 6 is a schematic structural view of a first fire splitting plate of the first combustion assembly shown in FIG. 4.

Further, as shown in FIGS. 3, 4 and 6, the first fire splitting plate 241 includes a first plate body portion 2411 and a first support portion 2412, and the first plate body portion 2411 is arranged spaced apart from the inner bottom surface of the box 21. One end of the first plate body portion 2411 abuts against the top plate 23, the other end of the first plate body portion 2411 extends toward the installation position of the first combustor 22, and the first plate body portion 2411 is matched with the inner bottom surface of the box 21 through the first support portion 2412. In one embodiment, one end of the first plate body portion 2411 abuts against the top plate 23, the other end of the first plate body portion 2411 extends to the installation position of the first combustor 22, and the first plate body portion 2411 is matched with the inner bottom surface of the box 21 through the first support portion 2412. The first plate body portion 2411 divides the space of the box 21 on the side of the first combustor 22 into two parts, an upper part and a lower part, in which the upper part is the first passage portion 261 and the lower part is the first passage section 251. The air reaches the installation position of the first combustor 22 through the first intake hole 2111 and the first passage section 251, and the combustion exhaust gas generated after the mixing and combustion of the air and gas is discharged through the first passage portion 261 and the first exhaust hole 2311, and ensuring that the air can flow in smoothly and the combustion exhaust gas can flow out smoothly, so that the gas can fully combust, and the power and thermal efficiency of the combustion device 1 are further improved.

It should be pointed out that the first support portion 2412 is provided at one end of the first plate body portion 2411 that is close to the installation position of the first combustor 22, and increasing the strength of the first plate body portion 2411, avoiding the influence of the high temperature generated by the first combustor 22 on the first fire splitting plate 241, and further ensuring the effect of intake and exhausting of the combustion device 1.

In addition, as shown in FIG. 6, the number of the first support portions 2412 is plural, and the first support portions 2412 are arranged spaced apart along an edge of the first plate body portion 2411 that is close to the installation position of the first combustor 22, and further improving the strength and stability of the first plate body portion 2411 so that the intake and exhausting effects of the combustion device 1 are further ensured.

Further, the edge of the first plate body portion 2411 abuts against a side wall of the box 21. In one embodiment, the first passage portion 261 of the exhaust passage 26 is formed between the first plate body portion 2411 and the top plate 23, and the first passage section 251 of the intake passage 25 is formed between the first plate body and the inner bottom surface of the box 21. One end of the first plate body portion 2411 abuts against the top plate 23, the other end of the first plate body portion 2411 extends toward the installation position of the first combustor 22, and the edges on both sides of the first plate body portion 2411 abut against the side walls of the box 21 respectively, so that the first passage section 251 and the first passage portion 261 can communicate only through the installation position of the first combustor 22, and other positions are isolated from each other, which further prevents the combustion exhaust gas from having an influence on the entry of the air and the combustion of the first combustor 22, so that the combustion power and thermal efficiency of the combustion device 1 are further improved.

In one embodiment, as shown in FIGS. 3, 4 and 6, the first plate body portion 2411 is of a first bend structure. One end of the first plate body portion 2411 abuts against the top plate 23, the other end of the first plate body portion 2411 extends toward the installation position of the first combustor 22, and the first plate body portion 2411 is arranged obliquely in the box 21, so that the first passage section 251 has a first contraction structure from the first intake hole 2111 to the installation position of the first combustor 22, and the first passage portion 261 has a first expansion structure from the installation position of the first combustor 22 to the first exhaust hole 2311. When the air enters through the first passage section 251 having the first contraction structure, a loss rate of the air entry can be increased, so that the amount of air entry is sufficient, which increases the air-fuel ratio; and when the combustion exhaust gas exits from the first passage portion 261 having the first expansion structure, it can effectively leave the combustion device 1, and the combustion exhaust gas can be prevented from stagnating and adversely affecting the combustion device 1.

It should be pointed out that the first bend structure bends in a discharge direction of the combustion exhaust gas, which further improves the discharging effect of the combustion exhaust gas.

Further, as shown in FIGS. 1 to 4, the first exhaust hole 2311 is a first elongated hole, and the first elongated hole extends in the length direction of the first combustor 22. In one embodiment, one end of the first plate body portion 2411 of the first fire splitting plate 241 abuts against the top plate 23, and the abutment position is located at an orifice edge of the first exhaust hole 2311 on the side away from the first combustor 22. Therefore, the first exhaust hole 2311 can effectively communicate with the first passage portion 261 of the exhaust passage 26 formed by the first plate body portion 2411 and the top plate 23. Since the first exhaust hole 2311 is the first elongated hole, and the length direction of the first elongated hole is consistent with the length direction of the first combustor 22, the discharging effect of the combustion exhaust gas is further improved and the adverse influence of the combustion exhaust gas on the combustion device 1 is effectively avoided.

It should be pointed out that the length of the first elongated hole is larger than or equal to the length of the first combustor 22, so that the discharging effect of the combustion exhaust gas is further improved.

Figure 5:
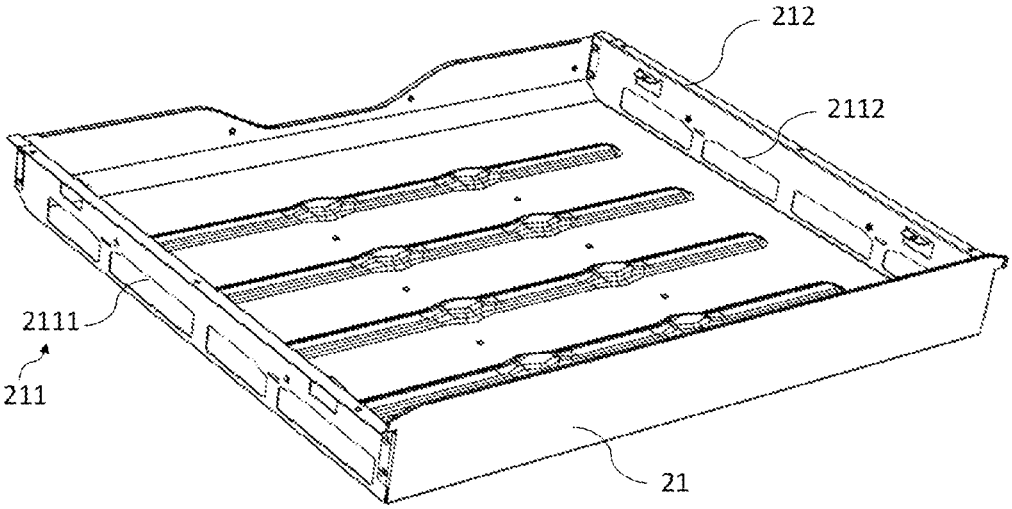
FIG. 5 is a schematic structural view of a box of the first combustion assembly shown in FIG. 4.

In one embodiment, as shown in FIGS. 3 to 5, the number of first intake holes 2111 is plural, and the first intake holes 2111 are provided on the side wall of the box 21 and/or the inner bottom surface of the box 21. By providing first intake holes 2111, the amount of air entry can be increased, so that the air-fuel ratio can be increased, and the power and thermal efficiency of the combustion device 1 can be improved.

In addition, when the number of the first intake holes 2111 is plural, the plurality of first intake holes 2111 may be all provided on the side wall of the box 21, or may be all provided on the inner bottom surface of the box 21. They may also be partly provided on the side wall of the box 21, and partly provided on the inner bottom surface of the box 21. The specific arrangement positions of the plurality of first intake holes 2111 are set according to actual requirements on use, and a detailed description will be omitted in the present application.

Further, as shown in FIGS. 3 to 5, the set of intake holes 211 include a second intake hole 2112, the set of exhaust holes 231 include a second exhaust hole 2312, and the fire splitting assembly 24 includes a second fire splitting plate 242. The second fire splitting plate 242, the second exhaust hole 2312 and the second intake hole 2112 are all located on the other side of the first combustor 22. A second passage portion 262 of the exhaust passage 26 is formed between the second fire splitting plate 242 and the top plate 23. Two ends of the second passage portion 262 communicate with the second exhaust hole 2312 and the installation position of the first combustor 22 respectively. A second passage section 252 of the intake passage 25 is formed between the second fire splitting plate 242 and the inner bottom surface of the box 21, and two ends of the second passage section 252 communicate with the second intake hole 2112 and the installation position of the first combustor 22 respectively. In one embodiment, the first combustor 22 is arranged in the box 21 and is located in a middle part of the box 21, the first fire splitting plate 241 is arranged on one side of the first combustor 22, and the second fire splitting plate 242 is arranged on the other side of the first combustor 22. One side surface of the first fire splitting plate 241 and the inner bottom surface of the box 21 form the first passage portion 261 of the intake passage 25, and one side surface of the second fire splitting plate 242 and the inner bottom surface of the box 21 form the second passage portion 262 of the intake passage 25. The first passage portion 261 communicates with the second passage portion 262 at the installation position of the first combustor 22. The other side surface of the first fire splitting plate 241 and the top plate 23 form the first passage section 251 of the exhaust passage 26, and the other side surface of the second fire splitting plate 242 and the top plate 23 form the second passage section 252 of the exhaust passage 26. The first passage section 251 communicates with the second passage section 252 at the installation position of the first combustor 22. The first passage portion 261 and the first passage section 251 form a first bend structure, and the second passage portion 262 and the second passage section 252 form a second bend structure. When the combustion device 1 is in operation, not only does the air reach the installation position of the first combustor 22 through the first intake hole 2111 and the first passage section 251, but also the air reaches the installation position of the first combustor 22 through the second intake hole 2112 and the second passage section 252. That is, the air is supplied on both sides of the first combustor 22. The combustion exhaust gas is not only discharged through the first passage portion 261 and the first exhaust hole 2311, but also the combustion exhaust gas is discharged through the second passage portion 262 and the second exhaust hole 2312; that is, exhaust gas is discharged on both sides of the first combustor 22, and improving the discharging effect, avoiding the adverse effect of stagnating of the combustion exhaust gas on the combustion device 1, and further increasing the power and thermal efficiency of the combustion device 1.

It should be understood that the first intake hole 2111 and the second intake hole 2112 are arranged symmetrically with respect to the first combustor 22, the first exhaust hole 2311 and the second exhaust hole 2312 are arranged symmetrically with respect to the first combustor 22, and the first fire splitting plate 241 and the second fire splitting plate 242 are arranged symmetrically with respect to the first combustor 22, and ensuring uniform and efficient intake and exhausting on both sides of the first combustor 22, so that the power and thermal efficiency of the combustion device 1 are improved.

Figure 7:
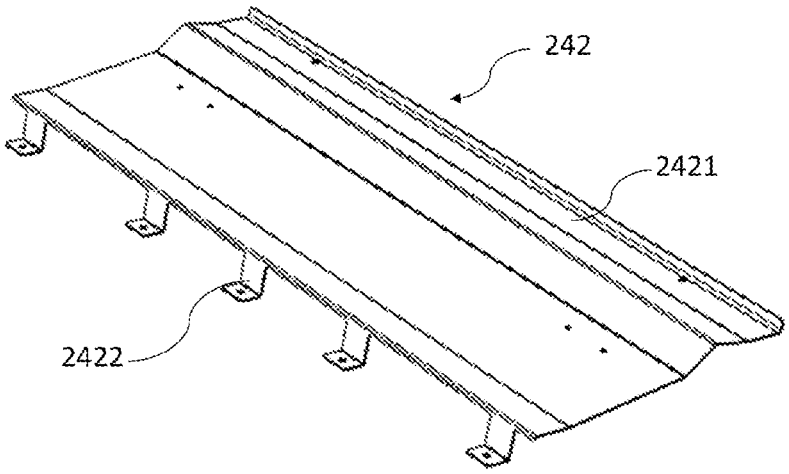
FIG. 7 is a schematic structural view of a second fire splitting plate of the first combustion assembly shown in FIG. 4.
Figure 8:
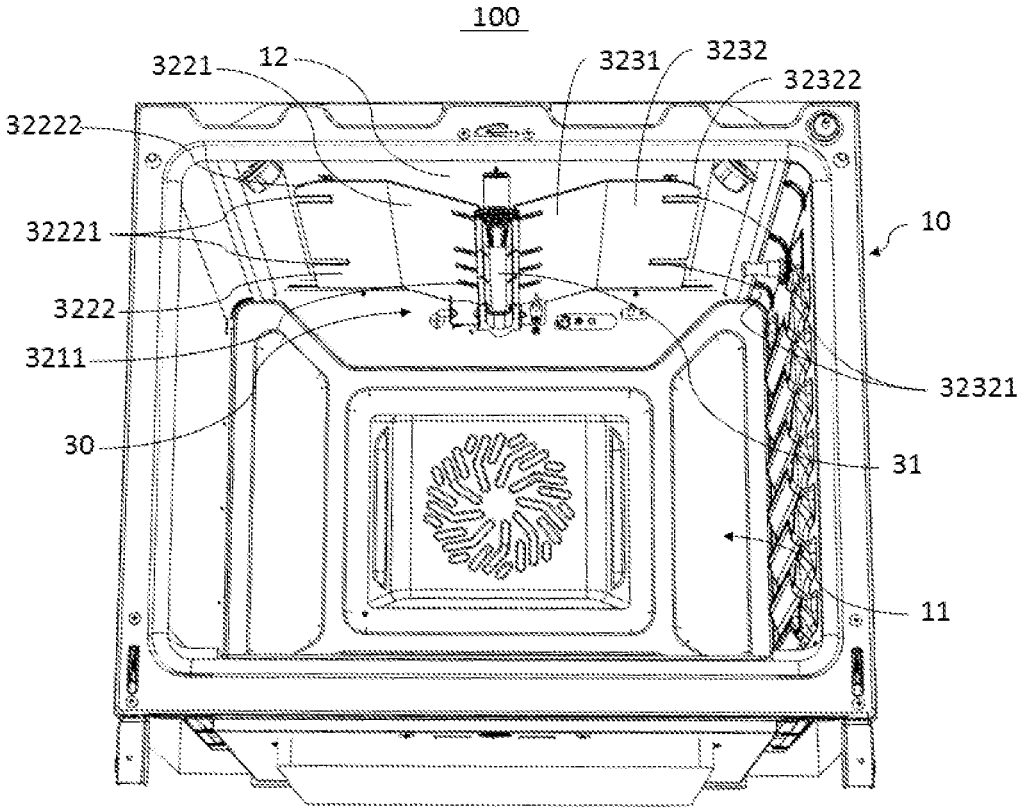
FIG. 8 is a schematic structural view of the cooking apparatus shown in FIG. 1 from another perspective.
Figure 9:
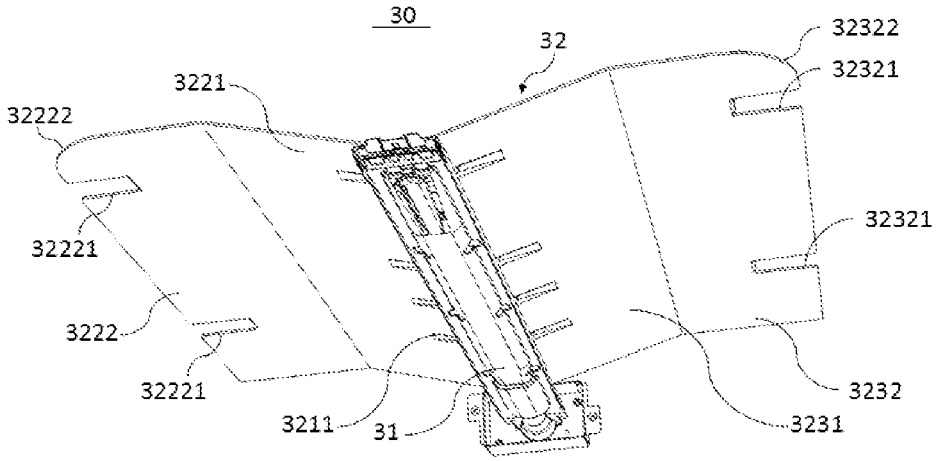
FIG. 9 is a schematic structural view of a second combustion assembly of the combustion device of the cooking apparatus shown in FIG. 8.
Figure 10:
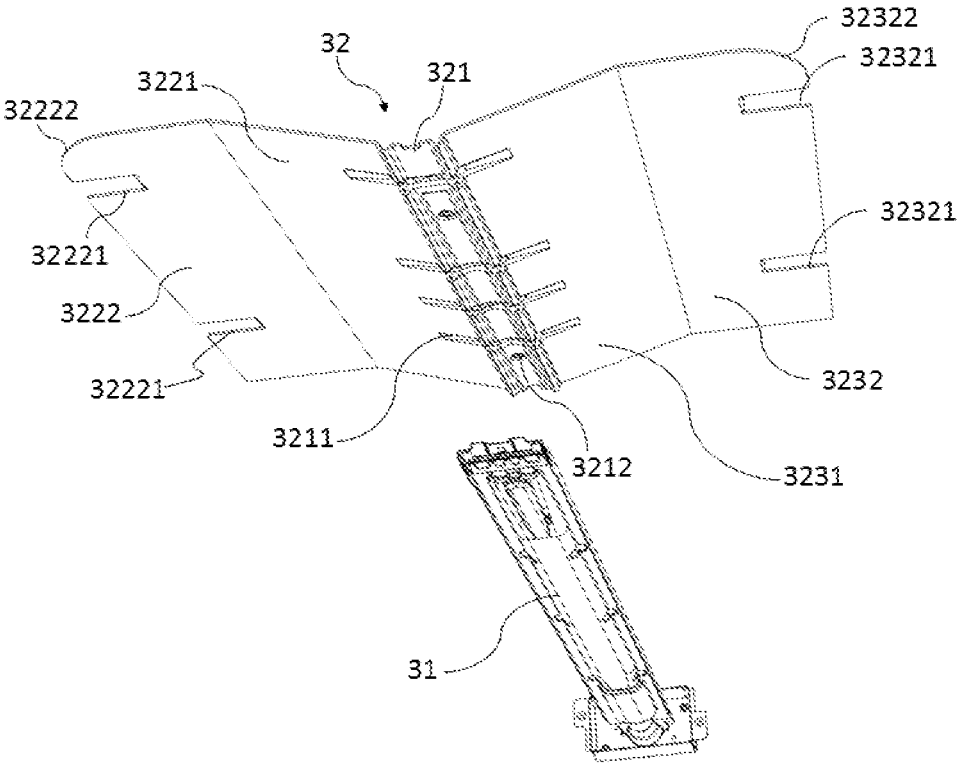
FIG. 10 is a schematic view of an exploded structure of the second combustion assembly shown in FIG. 9.

Further, as shown in FIGS. 3, 4 and 7, the second fire splitting plate 242 includes a second plate body portion 2421 and a second support portion 2422, and the second plate body portion 2421 is arranged spaced apart from the inner bottom surface of the box 21. One end of the second plate body portion 2421 abuts against the top plate 23, the other end of the second plate body portion 2421 extends toward the installation position of the first combustor 22, and the second plate body portion 2421 is matched with the inner bottom surface of the box 21 through the second support portion 2422. In one embodiment, one end of the second plate body portion 2421 abuts against the top plate 23, the other end of the second plate body portion 2421 extends to the installation position of the first combustor 22, and the second plate body portion 2421 is matched with the inner bottom surface of the box 21 through the second support portion 2422. The second plate body portion 2421 divides the space of the box 21 on the side of the first combustor 22 into two parts, an upper part and a lower part, in which the upper part is the second passage portion 262 and the lower part is the second passage section 252. The air reaches the installation position of the first combustor 22 through the second intake hole 2112 and the second passage section 252, and the combustion exhaust gas generated after the mixing and combustion of the air and gas is discharged through the second passage portion 262 and the first exhaust hole 2311, and ensuring that the air can flow in smoothly and the combustion exhaust gas can flow out smoothly, so that the gas can fully combust, and the power and thermal efficiency of the combustion device 1 are further improved.

It should be pointed out that the second support portion 2422 is provided at one end of the second plate body portion 2421 that is close to the installation position of the first combustor 22, and increasing the strength of the second plate body portion 2421, avoiding the influence of the high temperature generated by the first combustor 22 on the second fire splitting plate 242, and further ensuring the effect of intake and exhausting of the combustion device 1.

In addition, as shown in FIG. 7, the number of the second support portions 2422 is plural, and the second support portions 2422 are arranged spaced apart along an edge of the second plate body portion 2421 that is close to the installation position of the first combustor 22, and further improving the strength and stability of the second plate body portion 2421 so that the intake and exhausting effects of the combustion device 1 are further ensured.

Further, the edge of the second plate body portion 2421 abuts against the side wall of the box 21. In one embodiment, the second passage portion 262 of the exhaust passage 26 is formed between the second plate body portion 2421 and the top plate 23, and the second passage section 252 of the intake passage 25 is formed between the second plate body and the inner bottom surface of the box 21. One end of the second plate body portion 2421 abuts against the top plate 23, the other end of the second plate body portion 2421 extends toward the installation position of the first combustor 22, and the edges on both sides of the second plate body portion 2421 abut against the side walls of the box 21 respectively, so that the second passage section 252 and the second passage portion 262 can communicate only through the installation position of the first combustor 22, and other positions are isolated from each other, which further prevents the combustion exhaust gas from having an influence on the entry of the air and the combustion of the first combustor 22, so that the combustion power and thermal efficiency of the combustion device 1 are further improved.

In one embodiment, as shown in FIGS. 3, 4 and 7, the second plate body portion 2421 is of a second bend structure. One end of the second plate body portion 2421 abuts against the top plate 23, the other end of the second plate body portion 2421 extends toward the installation position of the first combustor 22, and the second plate body portion 2421 is arranged obliquely in the box 21, so that the second passage section 252 has a second contraction structure from the second intake hole 2112 to the installation position of the first combustor 22, and the second passage portion 262 has a second expansion structure from the installation position of the first combustor 22 to the second exhaust hole 2312. When the air enters through the second passage section 252 having the second contraction structure, a loss rate of the air entry can be increased, so that the amount of air entry is sufficient, which increases the air-fuel ratio; and when the combustion exhaust gas exits from the second passage portion 262 having the second expansion structure, it can effectively leave the combustion device 1, and the combustion exhaust gas can be prevented from stagnating and adversely affecting the combustion device 1.

It should be pointed out that the second bend structure bends in the discharge direction of the combustion exhaust gas, which further improves the discharging effect of the combustion exhaust gas.

Further, as shown in FIGS. 1 to 4, the second exhaust hole 2312 is a second elongated hole, and the second elongated hole extends in the length direction of the first combustor 22. In one embodiment, one end of the second plate body portion 2421 of the second fire splitting plate 242 abuts against the top plate 23, and the abutment position is located at an orifice edge of the second exhaust hole 2312 on the side away from the first combustor 22. Therefore, the second exhaust hole 2312 can effectively communicate with the second passage portion 262 of the exhaust passage 26 formed by the second plate body portion 2421 and the top plate 23. Since the second exhaust hole 2312 is the second elongated hole, and the length direction of the second elongated hole is consistent with the length direction of the first combustor 22, the discharging effect of the combustion exhaust gas is further improved and the adverse influence of the combustion exhaust gas on the combustion device 1 is effectively avoided.

It should be pointed out that the length of the second elongated hole is larger than or equal to the length of the first combustor 22, so that the discharging effect of the combustion exhaust gas is further improved.

In one embodiment, as shown in FIGS. 4 and 5, the number of second intake holes 2112 is plural, and the second intake holes 2111 are provided on the side wall of the box 21 and/or the inner bottom surface of the box 21. By providing second intake holes 2112, the amount of air entry can be increased, so that the air-fuel ratio can be increased, and the power and thermal efficiency of the combustion device 1 can be improved.

In addition, when the number of the second intake holes 2112 is plural, the plurality of second intake holes 2112 may be all provided on the side wall of the box 21, or may be all provided on the inner bottom surface of the box 21. They may also be partly provided on the side wall of the box 21, and partly provided on the inner bottom surface of the box 21. The specific arrangement positions of the plurality of second intake holes 2112 are set according to actual requirements on use, and a detailed description will be omitted in the present application.

As shown in FIGS. 8 to 12, according to the embodiment of the present disclosure, the combustion assembly further includes a second combustion assembly 30, and the second combustion assembly 30 includes a second combustor 31 and a radiation plate 32; the second combustor 31 is arranged in the cooking cavity 11 of the cooking apparatus and is configured to heat the cooking cavity 1, and the radiation plate 32 is arranged between the second combustor 31 and the top plate of the cooking cavity 11. The radiation plate 32 is a bend plate and extends in the length direction of the cooking cavity 11. The flames of the second combustor 31 flow along a side surface of the radiation plate 32 that is away from the top plate 12 of the cooking cavity.

In one embodiment, when the combustion assembly is used in the cooking apparatus 100, the combustion assembly is arranged in the cooking cavity 11 of the cooking apparatus 100 and is arranged close to the top plate 12 of the cooking cavity, and the top plate 12 of the cooking cavity and the second combustor 31 are arranged on both sides of the radiation plate 32 respectively. The radiation plate 32 is arranged in the length direction of the cooking cavity 11. When the second combustor 31 is activated, the gas is ignited, the flames flow along the side of the radiation plate 32 that is away from the top plate 12 of the cooking cavity, and the flames do not contact the top plate 12 of the cooking cavity, and reducing the temperature rise of the top plate 12 of the cooking cavity. In addition, the radiation plate 32 is a bend plate, which effectively extends the strokes of the flames flowing on the radiation plate 32, ensures that the gas can fully combust, reduces the generation of smoke, and guarantees the safety of the user during use. In addition, the radiation plate 32 is arranged in the length direction of the cooking cavity 11, the flames flow on the radiation plate 32, and the radiation plate 32 can provide a uniform and stable heat source for the cooking cavity 11 to ensure the cooking quality of the food. By improving the structure of the radiating plate 32, the disadvantages of the radiating plate 32 in the prior art are solved, and effectively improving the user experience and facilitating the promotion and popularization of product.

It should be understood that when the second combustor 31 is activated, the flames generated when the gas is combusting extend in the length direction of the cooking cavity 11. Since the radiation plate 32 extends in the length direction of the cooking cavity 11, the flames flow in the extension direction of the radiation plate 32, to prevent the flames from contacting the top plate 12 of the cooking cavity, so that the temperature rise of the top plate 12 of the cooking cavity is reduced, and chipping of the top plate 12 of the cooking cavity due to the high temperature-rise is avoided.

It should be pointed out that in the present application, the cooking apparatus 100 is placed on a bearing surface. When the user faces the cooking apparatus 100, a side of the cooking apparatus 100 that is close to the user is a front side, and a side of the cooking apparatus 100 that is away from the user is a rear side; a side of the cooking apparatus 100 that is located on the user's left hand is a left side, and a side of the cooking apparatus 100 that is located on the user's right hand is a right side; a side of the cooking apparatus 100 that is close to the bearing surface is a bottom side, and a side of the cooking apparatus 100 that is away from the bearing surface is a top side. A distance from the left side to the right side of the cooking cavity 11 is a width of the cooking cavity 11, a distance from the front side to the rear side of the cooking cavity 11 is a thickness of the cooking cavity 11, and a distance from the bottom side to the top side of the cooking cavity 11 is a height of the cooking cavity 11.

It is further understood that as shown in FIGS. 8 to 12, the radiation plate 32 includes a main plate body 321, a first plate body 322, and a second plate body 323. The main plate body 321 is arranged spaced apart from the top plate 12 of the cooking cavity, and the second combustor 31 is located on a side of the main plate body 321 that is away from the top plate 12 of the cooking cavity and is matched with the main plate body 321. The first plate body 322 is of a first bend structure and is connected to one side of the main plate body 321, and the second plate body 323 is of a second bend structure and is connected to the other side of the main plate body 321. In one embodiment, when the combustion assembly is used in the cooking apparatus 100, the combustion assembly is arranged in the cooking cavity 11 of the cooking apparatus 100 and is arranged close to the top plate 12 of the cooking cavity, and the radiation plate 32 is arranged between the second combustor 31 and the top plate 12 of the cooking cavity. The first plate body 322 and the second plate body 323 are respectively arranged on two opposite sides of the main plate body 321, the first plate body 322 extends toward one side plate of the cooking cavity 11, and the second plate body 323 extends toward the other side plate of the cooking cavity 11. When the cooking cavity 11 is being heated, the second combustor 31 is activated and the gas is ignited. The flames generated when the gas is combusting flow along the first plate body 322 and the second plate body 323 respectively. The first plate body 322 is of the first bend structure, and the second plate body 323 is of the second bend structure, so that the strokes of the flames are increased during the flow, which further ensures that the flames stay on the radiation plate 32 completely, and effectively avoids the contact of the flames and the top plate 12 of the cooking cavity so that the temperature rise of the top plate 12 of the cooking cavity is reduced. In addition, since the flames stay on the radiation plate 32 for a long time, it is ensured that the gas can fully combust, the generation of smoke (harmful gas such as carbon monoxide) is reduced, and the safety of the user is ensured.

It should be pointed out that the main plate body 321 is arranged at a middle position of the top of the cooking cavity 11, the main plate body 321 extends in a thickness direction of the cooking cavity 11, the second combustor 31 is matched with the main plate body 321, and the first plate body 322 and the second plate body 323 are symmetrically arranged on two opposite sides of the main plate body 321. After the second combustor 31 is started, the flames generated by the combustion of gas can be evenly distributed on the first plate body 322 and the second plate body 323, and ensuring the uniformity of the heat radiation of the radiation plate 32 to the cooking cavity 11 so that the heating effect on the food is ensured.

Further, as shown in FIGS. 8 to 12, the first plate body 322 includes a first portion 3221 and a second portion 3222. The first portion 3221 is connected to one side of the main plate body 321 and is arranged in a direction approaching the top plate 12 of the cooking cavity. The second portion 3222 is connected to the first portion 3221 and bends in a direction away from the top plate 12 of the cooking cavity. In one embodiment, one side of the first portion 3221 is connected to the main plate body 321, one side of the second portion 3222 is connected to the other side of the first portion 3221, and the other side of the second portion 3222 is in a suspended state and extends in a direction approaching one side wall of the cooking cavity 11. The first portion 3221 is arranged inclined to the main plate body 321, the first portion 3221 is inclined in a direction approaching the top plate 12 of the cooking cavity, and the second portion 3222 is inclined relative to the first portion 3221 and is inclined in a direction away from the top plate 12 of the cooking cavity. When the second combustor 31 is activated, the gas combusts to produce flames. The flames first flow through the first portion 3221, and then flow to the second portion 3222 through a connection position of the first portion 3221 and the second portion 3222. Since the first portion 3221 and the second portion 3222 form the first bend structures, the flow strokes of the flames are increased, so that the flames stay on the radiation plate 32 completely, the contact of the flames and the top plate 12 of the cooking cavity is avoided, and the temperature rise of the top plate 12 of the cooking cavity is further reduced.

It should be understood that when the flames flow along the first portion 3221 and the second portion 3222, the flames are turned multiple times, and improving the adhesion force between the flames and the first plate body 322, so that the flames can effectively flow in the bending direction of the first plate body 322, which further improves the diversion effect of the first plate body 322 on the flames, avoids the influence of the flames on the top plate 12 of the cooking cavity, enables the gas to fully combust, and reduces the amount of smoke generated.

It should be pointed out that the other end of the second portion 3222 is close to one side wall of the cooking cavity 11, and the second portion 3222 is arranged inclined to the side wall, to prevent the airflow after combustion from hitting the side wall and returning to the position of the first plate body 322 again to affect the combustion of the gas, so that the gas can fully combust, the amount of smoke generated is reduced, and the safety of the user is improved.

Figure 11:
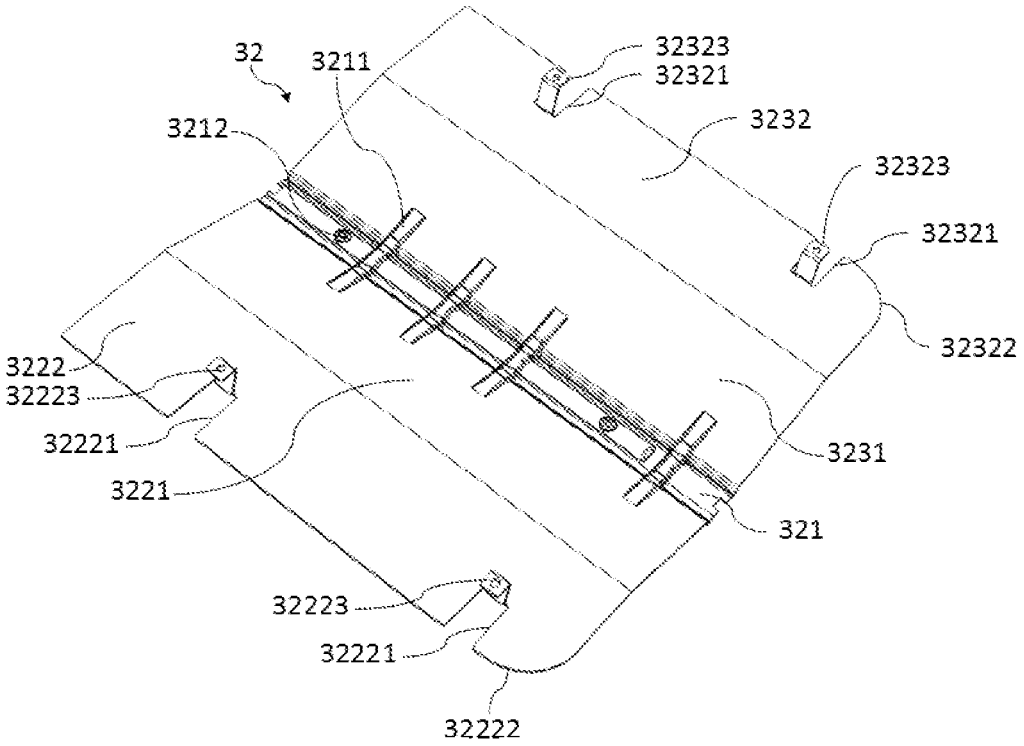
FIG. 11 is a schematic structural view of a radiation plate of the second combustion assembly shown in FIG. 9 from a first perspective.
Figure 12:
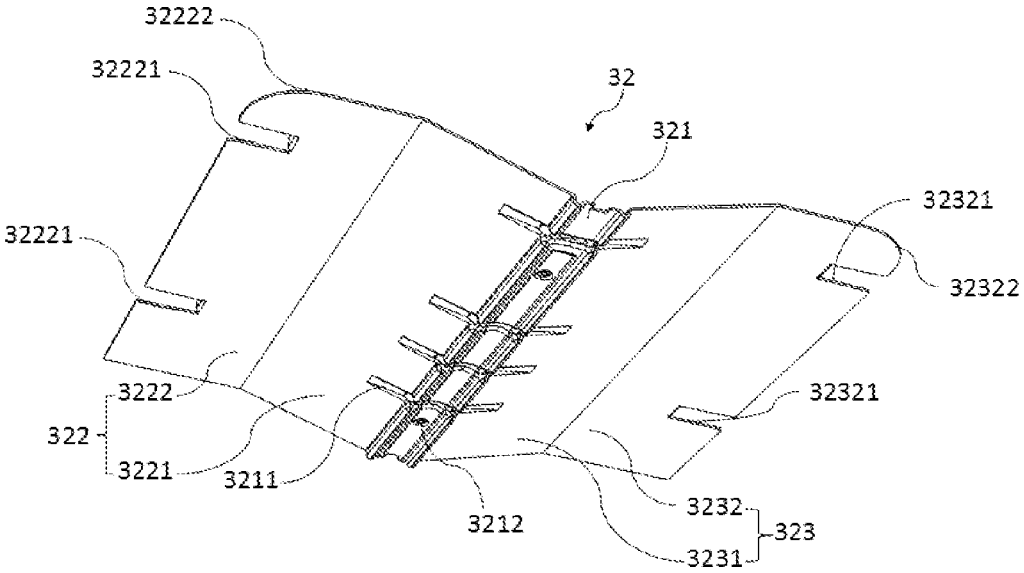
FIG. 12 is a schematic structural view of the radiation plate of the second combustion assembly shown in FIG. 9 from a second perspective.

Further, as shown in FIG. 11, a first connection structure 32223 is provided on the second portion 3222, and the first connection structure 32223 is configured to connect with the top plate 12 of the cooking cavity. In one embodiment, the first connection structure 32223 is provided on the second portion 3222, and the first connection structure 32223 protrudes out of a surface of the second portion 3222. When the first connection structure 32223 is connected with the top plate 12 of the cooking cavity, the first plate body 322 is arranged spaced apart from the top plate 12 of the cooking cavity (the second plate body 323 and the main plate body 321 of the radiation plate 32 are both arranged spaced apart from the plate body), which improves an isolation effect of the radiation plate 32 on the flames and further avoids the contact of the flames and the top plate 12 of the cooking cavity, so that the temperature rise of the top plate 12 of the cooking cavity is further reduced. In addition, the first connection structure 32223 is connected with the top plate 12 of the cooking cavity so that the strength of the radiation plate 32 is increased. When the flames are guided by the radiation plate 32, the possibility of deformation of the radiation plate 32 due to high temperature is reduced, so that the guiding effect of the radiation plate 32 on the flames is ensured.

Further, as shown in FIG. 11, the number of the first connection structures 32223 is plural, and the first connection structures 32223 are arranged spaced apart on the second portion 3222. In one embodiment, the first connection structures 32223 are arranged at intervals on the second portion 3222, and by providing first connection structures 32223, the connection strength between the radiation plate 32 and the top plate 12 of the cooking cavity is improved. When the flames are guided by the radiation plate 32, the possibility of deformation of the radiation plate 32 due to high temperature is further reduced, so that the guiding effect of the radiation plate 32 on the flames is further ensured.

In one embodiment, as shown in FIG. 11, an edge of the second portion 3222 that is away from the first portion 3221 is provided with a first cut 32221 toward an inner side of the second portion 3222. Materials removed at the position of the first cut 32221 bend in a direction approaching the top plate 12 of the cooking cavity to form the first connection structure 32223. The cut is provided on the edge of the second portion 3222, the materials removed at the position of the cut bend in the direction approaching the top plate 12 of the cooking cavity to form the first connection structure 32223, and a first through hole is provided on the first connection structure 32223, so that when connection is required, a first screw can pass through a second through hole to be matched with the top plate 12 of the cooking cavity. The assembly process is simple and easy to operate. In addition, the overall structure of the first connection structure 32223 is simple, which facilitates processing and manufacturing, and effectively reducing the manufacturing cost of the radiating plate 32.

In one embodiment, a first corner position of the second portion 3222 is provided with a first round chamfer 32222, and the first corner position is away from the first portion 3221 and close to an open end of the cooking cavity 11. An end of the second portion 3222 that is away from the first portion 3221 is in a suspended state, and the end of the second portion 3222 that is away from the first portion 3221 has two corners, in which one corner position is close to the open end of the cooking cavity 11, and the other corner position is away from the open end of the cooking cavity 11. The corner close to the open end of the cooking cavity 11 is the first corner position. By providing the first round chamfer 32222 at the first corner position, the user can be prevented from being scratched when picking and placing food in the cooking cavity 11, and ensuring the user's safety and effectively improving the user experience.

Further, as shown in FIGS. 8 to 12, the second plate body 3223 includes a third portion 3231 and a fourth portion 3232. The third portion 3231 is connected to the other side of the main plate body 321 and is arranged in the direction approaching the top plate 12 of the cooking cavity. The fourth portion 3232 is connected to the third portion 3231 and bends in the direction away from the top plate 12 of the cooking cavity. In one embodiment, one side of the third portion 3231 is connected to the main plate body 321, one side of the fourth portion 3232 is connected to the other side of the third portion 3231, and the other side of the fourth portion 3232 is in a suspended state and extends in the direction approaching the other side wall of the cooking cavity 11. The third portion 3231 is arranged inclined to the main plate body 321, the third portion 3231 is inclined in the direction approaching the top plate 12 of the cooking cavity, and the fourth portion 3232 is inclined relative to the third portion 3231 and is inclined in the direction away from the top plate 12 of the cooking cavity. When the second combustor 31 is activated, the gas combusts to produce flames. The flames first flow through the third portion 3231, and then flow to the fourth portion 3232 through a connection position of the third portion 3231 and the fourth portion 3232. Since the third portion 3231 and the fourth portion 3232 form the second bend structures, the flow strokes of the flames are increased, so that the flames stay on the radiation plate 32 completely, the contact of the flames and the top plate 12 of the cooking cavity is avoided, and the temperature rise of the top plate 12 of the cooking cavity is further reduced.

It should be understood that when the flames flow along the third portion 3231 and the fourth portion 3232, the flames are turned multiple times, and improving the adhesion force between the flames and the second plate body 323, so that the flames can effectively flow in the bending direction of the second plate body 323, which further improves the diversion effect of the second plate body 323 on the flames, avoids the influence of the flames on the top plate 12 of the cooking cavity, enables the gas to be fully combusted, and reduces the amount of smoke generated.

It should be pointed out that the other end of the fourth portion 3232 is close to one side wall of the cooking cavity 11, and the fourth portion 3232 is arranged inclined to the side wall, to prevent the airflow after combustion from hitting the side wall and returning to the position of the second plate body 323 again to affect the combustion of the gas, so that the gas can be fully combusted, the amount of smoke generated is reduced, and the safety of the user is improved.

Further, as shown in FIG. 11, a second connection structure 32323 is provided on the fourth portion 3232, and the second connection structure 32323 is configured to connect with the top plate 12 of the cooking cavity. In one embodiment, the second connection structure 32323 is provided on the fourth portion 3232, and the second connection structure 32323 protrudes out of a surface of the fourth portion 3232. When the second connection structure 32323 is connected with the top plate 12 of the cooking cavity, the second plate body 323 is arranged spaced apart from the top plate 12 of the cooking cavity, which improves the isolation effect of the radiation plate 32 on the flames and further avoids the contact of the flames and the top plate 12 of the cooking cavity, so that the temperature rise of the top plate 12 of the cooking cavity is further reduced. In addition, the second connection structure 32323 is connected with the top plate 12 of the cooking cavity so that the strength of the radiation plate 32 is increased. When the flames are guided by the radiation plate 32, the possibility of deformation of the radiation plate 32 due to high temperature is reduced, so that the guiding effect of the radiation plate 32 on the flames is ensured.

Further, as shown in FIG. 11, the number of the second connection structure 32323 is plural, and the second connection structure 32323 are arranged spaced apart on the fourth portion 3232. In one embodiment, the second connection structure 32323 are arranged at intervals on the fourth portion 3232, and by providing second connection structure 32323, the connection strength between the radiation plate 32 and the top plate 12 of the cooking cavity is improved. When the flames are guided by the radiation plate 32, the possibility of deformation of the radiation plate 32 due to high temperature is further reduced, so that the guiding effect of the radiation plate 32 on the flames is further ensured.

In one embodiment, as shown in FIG. 11, an edge of the fourth portion 3232 that is away from the third portion 3231 is provided with a second cut 32321 toward an inner side of the fourth portion 3232. Materials removed at the position of the second cut 32321 bend in the direction approaching the top plate 12 of the cooking cavity to form the second connection structure 32323. The cut is provided on the edge of the fourth portion 3232, the materials removed at the position of the cut bend in the direction approaching the top plate 12 of the cooking cavity to form the second connection structure 32323, and a second through hole is provided on the second connection structure 32323, so that when connection is required, a second screw can pass through the second through hole to be matched with the top plate 12 of the cooking cavity. The assembly process is simple and easy to operate. In addition, the overall structure of the second connection structure 32323 is simple, which facilitates processing and manufacturing, and effectively reducing the manufacturing cost of the radiating plate 32.

In one embodiment, as shown in FIGS. 8 to 12, a second corner position of the fourth portion 3232 is provided with a second round chamfer 32322, and the second corner position is away from the third portion 3231 and close to the open end of the cooking cavity 11. An end of the fourth portion 3232 that is away from the third portion 3231 is in a suspended state, and the end of the fourth portion 3232 that is away from the third portion 3231 has two corners, in which one corner position is close to the open end of the cooking cavity 11, and the other corner position is away from the open end of the cooking cavity 11. The corner close to the open end of the cooking cavity 11 is the second corner position. By providing the second round chamfer 32322 at the second corner position, the user can be prevented from being scratched when picking and placing food in the cooking cavity 11, and ensuring the user's safety and effectively improving the user experience.

Further, as shown in FIGS. 8 to 12, an installation groove 3211 is provided on the main plate body 321, an installation structure is provided on the second combustor 31, and the installation structure is adapted to be installed in the installation groove 3211. In one embodiment, when the second combustor 31 is matched with the main plate body 321, the second combustor 31 and the main plate body 321 are arranged correspondingly to each other, and the installation structure is arranged in the installation groove 3211. By providing the installation groove 3211 and the installation structure, the positioning and installation of the second combustor 31 is realized, and improving the installation accuracy of the second combustor 31, so that the heating effect of the gas combustion on the cooking cavity 11 is ensured.

It should be understood that the installation structure of the second combustor 31 is a convex structure adapted to the installation groove 3211. By arranging the convex structure in the installation groove 3211, a rapid positioning of the second combustor 31 is realized and the assembly efficiency of combustion assembly is further improved.

It should be pointed out that as shown in FIGS. 8 to 12, the number of installation grooves 3211 is plural, and the installation grooves 3211 are arranged spaced apart in the extension direction of the main plate body 321. The number of installation structures is the same as the number of installation grooves 3211, and the installation grooves 3211 are arranged corresponding to the installation structures. By providing the plurality of installation grooves 3211 and the plurality of installation structures, the installation accuracy of the second combustor 31 is further improved, so that the heating effect of the gas combustion on the cooking cavity 11 is further ensured.

Further, the combustion assembly further includes fasteners (not shown), and the second combustor 31 is connected to the main plate body 321 through the fasteners. In one embodiment, the main plate body 321 is provided with connection holes 3212, the second combustor 31 is arranged corresponding to the main plate body 321, and the installation structure on the second combustor 31 is correspondingly arranged in the installation groove 3211; then the fasteners are used to fix the second combustor 31 to the main plate body 321. The overall assembly process is simple and quick, and the assembly efficiency of the combustion assembly is effectively improved.

It should be pointed out that the fasteners are pins or screws or the like. In the present application, the fasteners are screws. The connection holes 3212 on the main plate body 321 are threaded holes. The screws pass through the second combustor 31 and are threaded to the threaded holes. The assembly efficiency is further improved, and the connection strength and stability of the second combustor 31 and the main plate body 321 are ensured.

Figure 13:
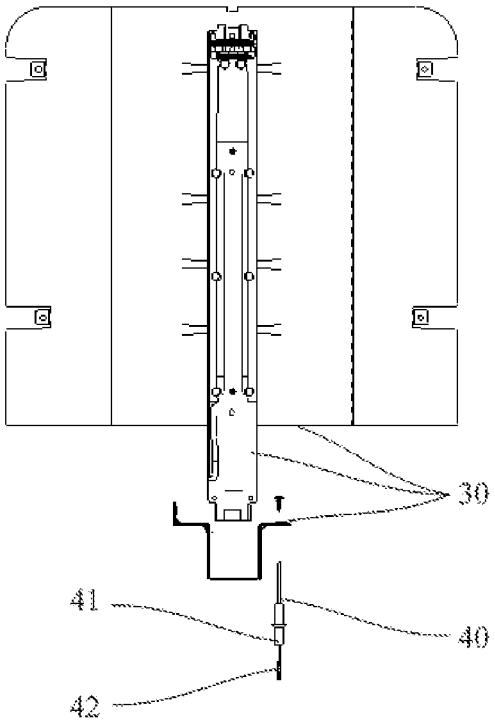
FIG. 13 is a schematic view of an exploded structure of the second combustion assembly and a combustion inductor in the cooking apparatus shown in FIG. 8.
Figure 14:
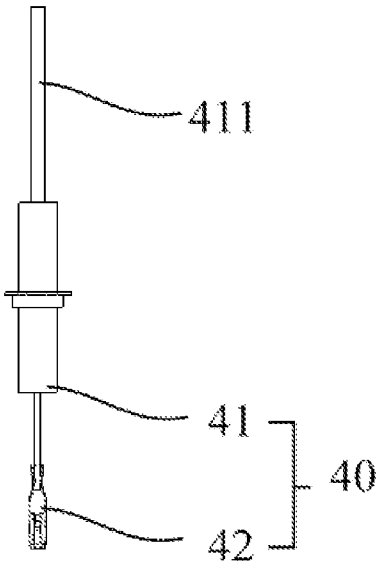
FIG. 14 is a schematic structural view of the combustion inductor shown in FIG. 13.

Further, as shown in FIGS. 13 and 14, the combustion device further includes a combustion inductor 40, which is arranged on the combustion assembly, so that the combustion inductor 40 can contact the flames during the combustion, which facilitates monitoring the operation of the combustor according to the flame state to ensure the safety. The combustion inductor 40 includes an inductor body 41 and a wiring terminal 42 for detecting flames and connecting with a wire harness respectively; the wiring terminal 42 and the inductor body 41 are detachably connected to each other, so that the inductor body 41 and the wire harness are electrically conducted through the wiring terminal 42.

When the combustion device needs to be disassembled, for example, when a cabinet 10 of the cooking apparatus 100 needs to be repaired, the wiring terminal 42 of the combustion inductor 40 can be disconnected from the inductor body 41, so that the combustion device can be wholly disassembled without disassembling a rear plate of the cabinet 10 and related electrical components and circuits or moving the cabinet 10. Therefore, the disassembly and assembly operations are simplified, and the overall disassembly and removal of the combustion device are facilitated, which is especially suitable for a large-scale cooking apparatus 100, such as a built-in oven. In addition, since the wiring terminal 42 and the inductor body 41 are of a split structure, the restriction of the inductor body 41 to the material selection of the wiring terminal 42 is reduced, so that the wiring terminal 42 can be made of a material with a higher strength level, which is advantageous for improving the reliability of the wiring terminal 42 and which also facilitates processing and molding.

The combustion device in this embodiment simplifies the disassembly and assembly process through the improvement of the combustion inductor 40, reduces the difficulty of disassembly and assembly, and can greatly reduce the possibility of damage to the combustion inductor 40 during the disassembly and assembly process. At the same time, it can also prolong the service life of the combustion inductor 40, which helps reduce maintenance cost.

Further, as shown in the drawings, the inductor body 41 is arranged at one end of the combustion assembly, so that during the combustion process, the inductor body 41 is located at the edge of the combustion area and can contact the flames, to detect the flame state. The wiring terminal 42 is arranged at the end of the inductor body 41 that is away from the combustion assembly. During the combustion process, the wiring terminal 42 can be kept away from the flames, which is convenient for wiring and can also reduce the possibility of damage to the wiring terminal 42 and the wire harness.

Figure 15:
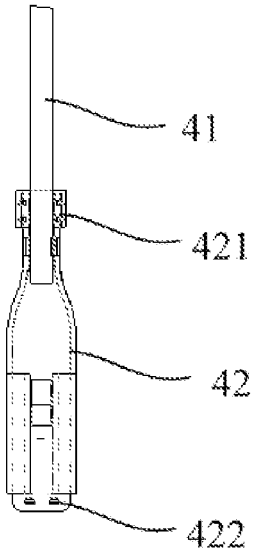
FIG. 15 is a schematic partial structural view of the combustion inductor shown in FIG. 13.
Figure 16:
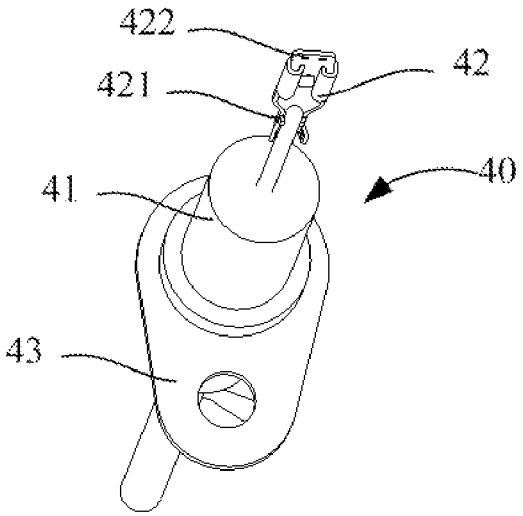
FIG. 16 is a schematic view of the combustion inductor shown in FIG. 13 from another perspective.

Further, as shown in FIGS. 13 to 14, a snap-fit structure 421 is provided on the wiring terminal 42, and is located on the wiring terminal 42 at a position close to the inductor body 41; the shape of the snap-fit structure 421 is adapted to the inductor body 41. In one embodiment, it may be a bend structure as shown in FIGS. 15 and 16. By inserting the end of the inductor body 41 into the bend structure of the wiring terminal 42, a snap-fit connection is formed with the inductor body 41 by using the bend structure; when it is necessary to disconnect the wiring terminal 42 from the inductor body 41, the wiring terminal 42 or the inductor body 41 can be directly pulled out to realize the disconnection, and the disassembly and assembly operations are convenient. When the snap-fit structure 421 and the inductor body 41 are in a snap-fit state, the wiring terminal 42 and the inductor body 41 are electrically conducted, so that a flame signal detected by the inductor body 41 can be transmitted to a corresponding control terminal through the wiring terminal 42 and lines.

Furthermore, a strength of the wiring terminal 42 is greater than a strength of the inductor body 41. It can be understood that since the inductor body 41 needs to be made of a high-temperature resistant material, in a common integrated structure, the selection of materials for the wiring part is limited, and it is easy to cause damage during multiple disassembly and assembly processes. However, in this embodiment, since the wiring terminal 42 and the inductor body 41 are of a split structure, materials with a higher strength can be specially selected for the wiring terminal 42 to reduce the possibility of damage to the wiring terminal 42 and the wire harness during the disassembly and assembly process, which is advantageous for improving the reliability of the wiring terminal 42 and prolonging the overall life of the combustion inductor 40.

Further, as shown in FIGS. 13 to 15, a wiring hole 422 is provided on the wiring terminal 42 to facilitate the connection of the wire harness. In one embodiment, the wiring hole 422 is located at one end of the wiring terminal 42 that is away from the inductor body 41, which is advantageous for shortening the length of the wire harness, reduces the winding of the wire harness, and facilitates wiring; meanwhile, the wire harness can be kept away from the combustion area as much as possible to further reduce the possibility of damage to the wire harness.

Further, at least part of the outer surface of the wiring terminal 42 is provided with an insulating layer, such as a rubber layer, which may be arranged on the other side of the wiring terminal 42 opposite to the snap-fit structure 421, thus making it convenient for the operator to hold during the disassembly and assembly operations to avoid affecting signal transmission.

Further, as shown in FIGS. 13 to 15, at least part of the inductor body 41 is of a rod-shaped structure. For example, the end of the inductor body 41 is of a rod-shaped structure, or the entirety of the inductor body 41 is of a rod-shaped structure. The overall volume of the combustion inductor 40 is greatly reduced, material is saved, and it is easy to install and fix. In addition, since the wiring terminal 42 is detachably connected to the inductor body 41, the shape of the wiring terminal 42 is adapted to the end of the inductor body 41, which can reduce the volume of the wiring terminal 42 accordingly and meanwhile facilitate the processing and molding of the wiring terminal 42. Also, the difficulty of disassembly and assembly between the wiring terminal 42 and the inductor body 41 can be reduced.

Further, as shown in FIG. 14, the inductor body 41 is provided with an induction probe 411 at one end facing the combustion assembly, so that the induction probe 411 is used to detect the flames during combustion, which facilitates sensing and is especially suitable for detecting the flames generated by combustion of gas fuel.

Further, as shown in FIGS. 13 to 16, the combustion inductor 40 further includes a connection bracket 43. The connection bracket 43 is arranged on the inductor body 41, and In one embodiment may be sleeved over the inductor body 41 or directly welded to the inductor body 41; the connection bracket 43 protrudes outward in a radial direction of the inductor body 41, and is provided with a connection structure, such as a connection hole 3212 or a connection bolt, to facilitate disassembly and assembly operations. When the combustion inductor 40 is assembled with the combustion assembly, the connection bracket 43 is used for installation and connection.

Further, the combustion inductor 40 is In one embodiment an ion inductor. During the combustion process, the ion inductor can sense the change of ions, then sense the flames, and detect the flame state. The detection accuracy is higher, and the response is better and faster, which is especially suitable for the detection of flames generated by gas combustion.

Figure 17:
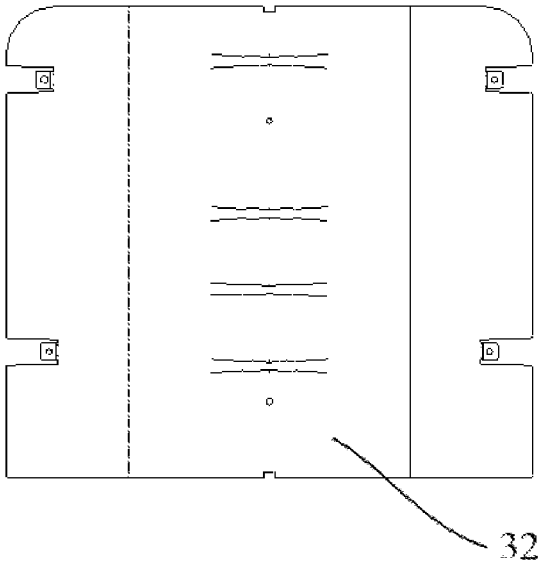
FIG. 17 is a schematic structural view of the radiation plate shown in FIG. 13.
Figure 18:
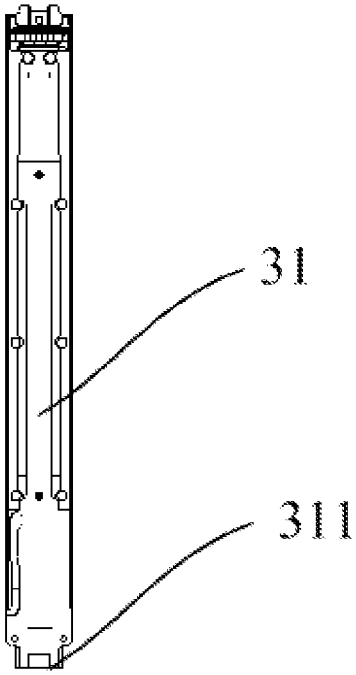
FIG. 18 is a schematic structural view of a second combustor shown in FIG. 13.

Further, as shown in FIGS. 13, 17 and 18, the combustion assembly includes the second combustor 31 and the radiation plate 32. The fire row of the second combustor 31 is used to distribute the combustion flames, and may have a cylindrical structure as shown in FIG. 18. The radiation plate 32 is connected to one side of the fire row. During the combustion process, the radiation plate 32 can radiate heat to promote heating. When assembling the combustion device, the fire row is connected to the interior of the cabinet 10 of the cooking apparatus 100 through the radiation plate 32. The combustion inductor 40 is arranged on the fire row of the second combustor 31 at a position close to the intake end 311, and the combustion inductor 40 is arranged in an axial direction of the fire row to facilitate flame detection.

Figure 19:
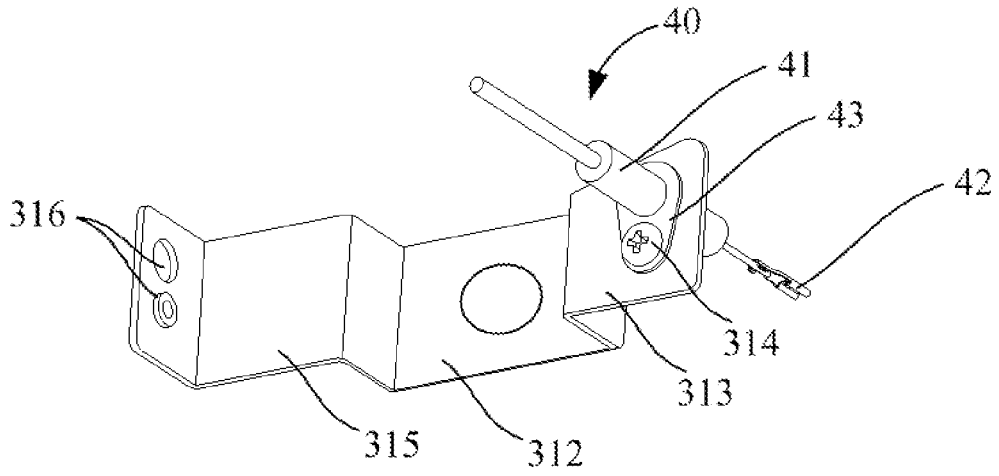
FIG. 19 is a schematic view showing the assembly of a fixing bracket and the combustion inductor shown in FIG. 13.
Figure 20:
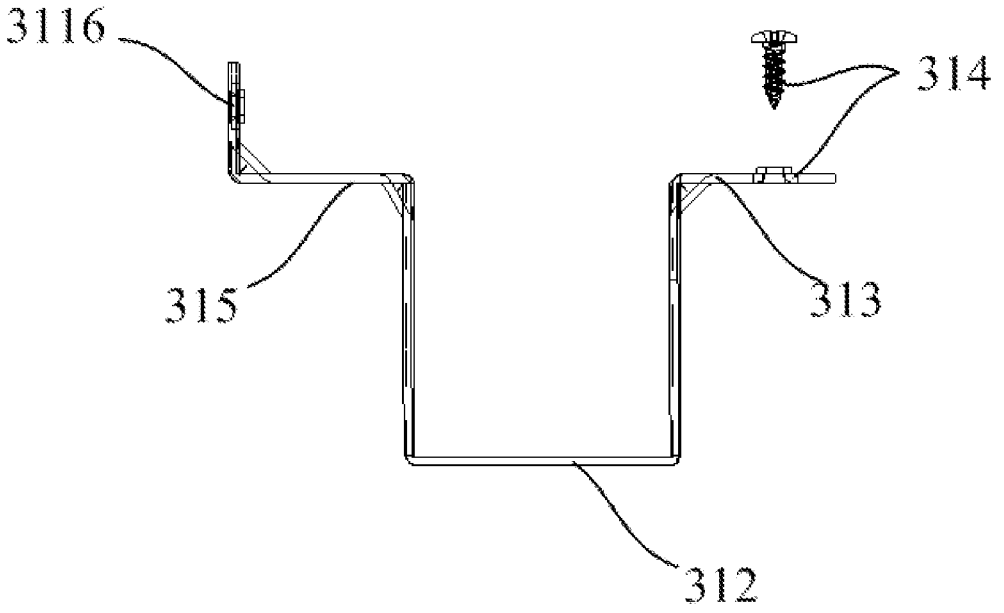
FIG. 20 is a schematic view of the fixing bracket shown in FIG. 19.
Figure 21:
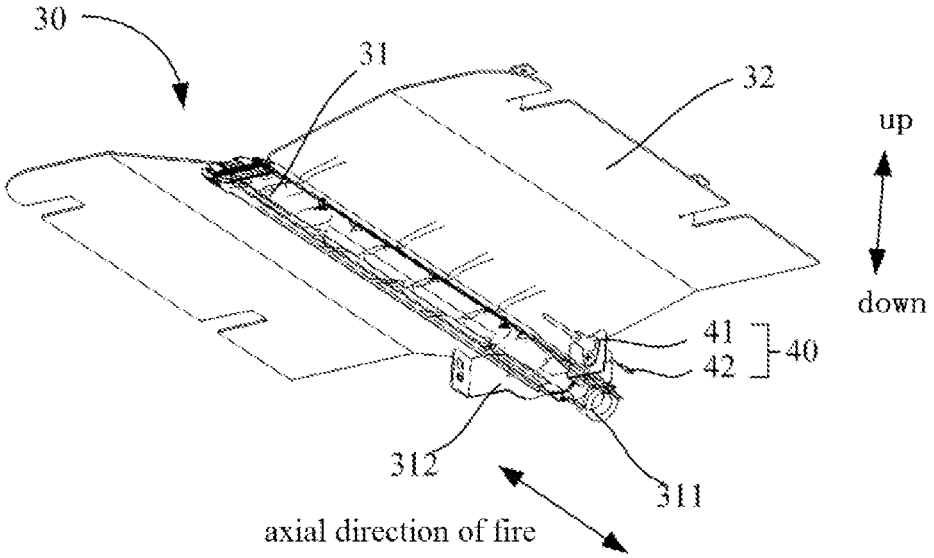
FIG. 21 is a schematic structural view showing the assembly of the second combustion assembly and the combustion inductor shown in FIG. 13.

Further, as shown in FIGS. 13, 19 and 20, the combustion assembly further includes a fixing bracket 312. The fixing bracket 312 is arranged on the fire row of the second combustor 31 at a position close to the intake end 311; In one embodiment, the fixing bracket 312 may be sleeved over the fire row of the second combustor 31, and is welded and fixed with the fire row of the second combustor 31. The fixing bracket 312 is provided with a first installation plate 313 extending toward one side in the radial direction of the fire row of the second combustor 31, and the first installation plate 313 is provided with a third connection structure 314 such as a connection hole 3212 and a connection bolt. The combustion inductor 40 is arranged in the connection hole 3212, and is fixedly connected to the first installation plate 313 through the connection bolt.

Further, the third connection structure 314 faces the axial direction of the fire row of the second combustor 31. When repairing the cabinet 10 of the cooking apparatus 100, the operator can operate the third connection structure 314 through an oven door of the cabinet 10 to disassemble and assemble the combustion inductor 40 without disassembling and assembling or moving the cabinet 10 wholly, which is convenient for operation, especially for a large-scale cooking apparatus 100 such as a built-in oven, and reducing the difficulty of maintenance, disassembly and assembly.

Furthermore, the fixing bracket 312 is also provided with a second installation plate 315, which may be a bend plate as shown in FIGS. 19 and 20, and the second installation plate 315 is provided with a fourth connection structure 316 such as a connection hole 3212 and a connection bolt so that the second installation plate 315 is connected and fixed to the igniter 60 through the fourth connection structure 316. The second installation plate 315 is located on a side of the fixing bracket 312 that is opposite to the first installation plate 313, so that the fixing bracket 312 can serve as an installation base for the combustion inductor 40 and the igniter 60 at the same time, which is advantageous for simplifying the overall structure. The combustion inductor 40 and the igniter 60 are respectively located on both sides of the fire row of the second combustor 31, so that a proper distance is maintained between the combustion inductor 40 and the igniter 60, and mutual interference or influence between the two can be prevented.

Further, as shown in the drawings, the combustion device includes the combustion assembly and the combustion inductor 40, which may be used in the cooking apparatus 100 having the cabinet 10, and the combustion device is integrally arranged in the cabinet 10 of the cooking apparatus 100.

Further, the combustion assembly includes the second combustor 31, the radiation plate 32 and the fixing bracket 312. As shown in FIGS. 13, 17 and 18, the fire row of the second combustor 31 has a cylindrical structure and is configured to distribute the combustion flames. The radiation plate 32 is connected to one side of the fire row of the second combustor 31. During the combustion process, the radiation plate 32 can radiate heat to promote heating. When assembling the combustion device, the second combustor 31 is connected to the interior of the cabinet 10 of the cooking apparatus 100 through the radiation plate 32.

As shown in FIG. 13 and FIGS. 19 to 21, the fixing bracket 312 is arranged on the fire row of the second combustor 31 at a position close to the intake end 311. In one embodiment, it may be sleeved over the fire row and welded and fixed to the fire row. The fixing bracket 312 is provided with the first installation plate 313 and the second installation plate 315 extending toward two sides in the radial direction of the fire row respectively. In addition, the first installation plate 313 is provided with the third connection structure 314, such as the connection hole 3212 and the connection bolt. The combustion inductor 40 is arranged in the connection hole 3212 and is fixedly connected to the first installation plate 313 through the connection bolt. The third connection structure 314 faces the axial direction of the fire row, so that the combustion inductor 40 is arranged in the axial direction of the fire row to facilitate flame detection. When repairing the cabinet 10 of the cooking apparatus 100, the operator can operate the third connection structure 314 through the oven door of the cabinet 10 to disassemble and assemble the combustion inductor 40 without disassembling and assembling or moving the cabinet 10 wholly, which is convenient for operation, especially for a large-scale cooking apparatus 100 such as a built-in oven, and reducing the difficulty of maintenance, disassembly and assembly.

The second installation plate 315 is a bend plate. The second installation plate 315 is provided with the fourth connection structure 316, such as the connection hole 3212 and the connection bolt, so that the second installation plate 315 is connected and fixed to the igniter 60 through the fourth connection structure 316. The second installation plate 315 is located on the side of the fixing bracket 312 that is opposite to the first installation plate 313, so that a proper distance is maintained between the combustion inductor 40 and the igniter 60, which can prevent mutual interference or influence between the two.

As shown in FIGS. 13 to 16, the combustion inductor 40 includes the inductor body 41, the wiring terminal 42 and the connection bracket 43, which are respectively used for detecting flames and connecting with the wire harness; the wiring terminal 42 and the inductor body 41 are detachably connected, so that the inductor body 41 and the wire harness are electrically conducted through the wiring terminal 42. During the combustion process, the inductor body 41 is located at the edge of the combustion area and can contact the flames, to detect the flame state. The wiring terminal 42 is arranged at the end of the inductor body 41 that is away from the combustion assembly. During the combustion process, the wiring terminal 42 can be kept away from the flames, which is convenient for wiring and can also reduce the possibility of damage to the wiring terminal 42 and the wire harness.

As shown in FIGS. 13 to 15, the snap-fit structure 421 is provided on the wiring terminal 42, and is located on the wiring terminal 42 at a position close to the inductor body 41; the shape of the snap-fit structure 421 is adapted to the inductor body 41. In one embodiment, the snap-fit structure 421 is a bend structure as shown in FIGS. 15 and 16. By inserting the end of the inductor body 41 into the bend structure of the wiring terminal 42, a snap-fit connection is formed with the inductor body 41 by using the bend structure; when it is necessary to disconnect the wiring terminal 42 from the inductor body 41, the wiring terminal 42 or the inductor body 41 can be directly pulled out to realize the disconnection, and the disassembly and assembly operations are convenient. When the snap-fit structure 421 and the inductor body 41 are in a snap-fit state, the wiring terminal 42 and the inductor body 41 are electrically conducted, so that a flame signal detected by the inductor body 41 can be transmitted to a corresponding control terminal through the wiring terminal 42 and lines.

As shown in FIGS. 13 to 15, the wiring hole 422 is provided on the wiring terminal 42 to facilitate the connection of the wire harness. In one embodiment, the wiring hole 422 is located at one end of the wiring terminal 42 that is away from the inductor body 41, which is advantageous for shortening the length of the wire harness, reduces the winding of the wire harness, and facilitates wiring; meanwhile, the wire harness can be kept away from the combustion area as much as possible to further reduce the possibility of damage to the wire harness.

Further, at least part of the outer surface of the wiring terminal 42 is provided with an insulating layer, such as a rubber layer, which may be arranged on the other side of the wiring terminal 42 opposite to the snap-fit structure 421, thus making it convenient for the operator to hold during the disassembly and assembly operations to avoid affecting signal transmission.

Further, as shown in FIG. 14, the inductor body 41 is provided with an induction probe 411 at one end facing the combustion assembly, so that the induction probe 411 is used to detect the flames during combustion, which facilitates sensing and is especially suitable for detecting the flames generated by combustion of gas fuel.

As shown in FIGS. 13 to 15, the inductor body 41 is of a rod-shaped structure, and the shape of the wiring terminal 42 is adapted to the end of the inductor body 41.

As shown in FIGS. 13 to 16, the connection bracket 43 is sleeved over the inductor body 41 and is welded and fixed to the inductor body 41. The connection bracket 43 protrudes outward in the radial direction of the inductor body 41, and the protruding part of the connection bracket 43 is provided with the connection structure, such as the connection hole 3212 or the connection bolt, to facilitate disassembly and assembly operations. When the combustion inductor 40 is assembled with the combustion assembly, the connection bracket 43 is used for installation and connection.

Further, the combustion inductor 40 is In one embodiment an ion inductor. During the combustion process, the ion inductor can sense the change of ions, then sense the flames, and detect the flame state. The detection accuracy is higher, and the response is better and faster, which is especially suitable for the detection of flames generated by gas combustion.

Further, the material of the wiring terminal 42 is different from the material of the inductor body 41, and the strength of the wiring terminal 42 is greater than the strength of the inductor body 41.

When the combustion device needs to be disassembled, for example, when the cabinet 10 of the cooking apparatus 100 needs to be repaired, the wiring terminal 42 of the combustion inductor 40 can be disconnected from the inductor body 41, so that the combustion device can be wholly disassembled without disassembling the rear plate of the cabinet 10 and related electrical components and circuits or moving the cabinet 10. Therefore, the disassembly and assembly operations are simplified, and the overall disassembly and removal of the combustion device are facilitated, which is especially suitable for a large-scale cooking apparatus 100, such as a built-in oven. In addition, since the wiring terminal 42 and the inductor body 41 are of a split structure, the restriction of the inductor body 41 to the material selection of the wiring terminal 42 is reduced, so that the wiring terminal 42 can be made of a material with a higher strength level, which is advantageous for improving the reliability of the wiring terminal 42 and which also facilitates processing and molding.

The combustion device in this embodiment simplifies the disassembly and assembly process through the improvement of the combustion inductor 40, reduces the difficulty of disassembly and assembly, and can greatly reduce the possibility of damage to the combustion inductor 40 during the disassembly and assembly process. At the same time, it can also prolong the service life of the combustion inductor 40, which helps reduce maintenance cost.

As shown in FIGS. 1 to 22, this embodiment provides a cooking apparatus 100, which includes a cabinet 10, at least one combustion device in any of the above embodiments, an igniter 60, and an electronic control assembly 70.

The cabinet 10 serves as the base of the cooking apparatus 100, and a door 50 for opening or closing the cabinet 10 is provided on one side of the cabinet 10. The combustion device is arranged in the cabinet 10 to heat or roast food through combustion; the axial direction of the combustion assembly of the combustion device is opposite to the door 50, so that the operator can operate the combustion device through the door 50 during the disassembly and assembly process. The igniter 60 is used for ignition operation. The electronic control assembly 70 is arranged on the rear plate of the cabinet 10, that is, on the side plate opposite to the door 50, and the electronic control assembly 70 is electrically connected to the igniter 60 and the combustion inductor 40 of the combustion device to control the igniter 60 and the combustion inductor 40.

The wiring terminal 42 of the combustion inductor 40 is detachably connected to the inductor body 41, and when the inductor body 41 is disconnected from the wiring terminal 42, the combustion device can be disassembled without detaching the rear plate of the cabinet 10 and the corresponding electronic control assembly 70 and wire harness, which simplifies the disassembly and assembly operations of the combustion device, and facilitates the maintenance of the cabinet 10.

The cooking apparatus 100 in this embodiment includes but is not limited to an oven. In one embodiment, the cooking apparatus 100 may be a built-in oven.

In addition, the cooking apparatus 100 in this embodiment also has all the advantageous effects of the combustion device in any of the foregoing embodiments, which will not be described repeatedly herein.

Figure 22:
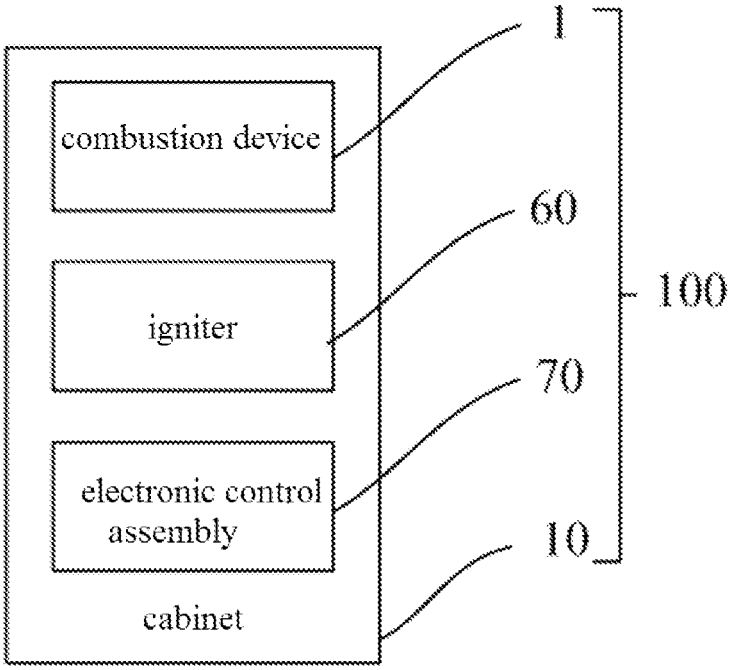
FIG. 22 schematically shows a schematic block diagram of the cooking apparatus according to the embodiment of the present application.

Further, as shown in FIGS. 13 and 22, the number of combustion devices is In one embodiment two, one of which is connected to the top plate of the cabinet 10, and the other of which is connected to the bottom plate of the cabinet 10. Each of the combustion devices is provided with an igniter 60, and the two combustion devices may perform the combustion operation at the same time, to promote heating or roasting of the food.

The following is a specific embodiment of the application.

This embodiment provides a combustor assembly, which adopts a split type terminal, and the entire combustor assembly can be taken out without detaching the rear plate of the cabinet 10, which facilitates disassembly and assembly, reduces the damage caused by disassembly and assembly, and increases the service life of the whole machine. The strength at the joint of the split type terminal is high. Compared with the integrated terminal, disassembly and assembly can be performed for more times, damage to the wire harness during disassembly and assembly is avoided, safety risk is reduced and it is safer. When the ion inductor fails, the damaged part of the detachable joint can be replaced without replacing the entire component, which reduces the cost.

For example, a detachable combustor assembly includes a second combustor 31, a radiation plate 32, an ignition needle holder, an ion inductor, a self-locking terminal, an ion inductor installation bracket, etc. When the cabinet 10 needs to be repaired due to failure, the radiation plate 32 and an ion inductor screw facing the oven door are removed first, then an ignition needle screw is removed, and finally the entire combustor is taken out. There is no need to detach the rear plate of the cabinet 10 to pull out the ion inductor and ignition needle wire. After the entire combustor assembly is detached, the embedded machine is embedded in a cupboard, and there is no need to remove the machine. A single person can complete the operation, making the operation simple and avoiding damage to the machine during disassembly and assembly.

By connecting the ion inductor probe to a wire body through the detachable terminal, the self-locking terminal ensures that the ion inductor probe is separated from an ignition needle head and the wire body, which enhances a plugging and unplugging force between the terminals, makes it easier to disassemble and assemble, and enables a selective replacement of the damaged part during maintenance.

An ion inductor installation piece makes the installation screw right face the oven door and be directly detachable. When detaching, the ion inductor can be selectively removed according to the damaged part.

As shown in FIGS. 1 to 22, the present application also proposes a cooking apparatus 100, which includes a cabinet 10, a door 50, a combustion device, an igniter 60, and an electric control assembly 70. The cabinet 10 is provided with a cooking cavity 11, and the door 50 is pivotally connected to the cabinet 10 to open or close the cooking cavity 11. The combustion device is the combustion device 1 as described above, and the combustion device 1 is arranged in the cooking cavity 11 and is configured to heat the cooking cavity 11. The axial direction of the combustion assembly of the combustion device 1 is opposite to the door 50 and is detachably connected to the combustion assembly. The electronic control assembly 70 is electrically connected to the combustion inductor 40 of the combustion device 1 and the igniter 60 respectively.

In addition, the above cooking apparatus is an oven or a grill, etc. For the structure of other parts of the cooking apparatus, reference may be made to the prior art, so a detailed description thereof will be omitted in the present application.

What is claimed is:

1. A combustion device for a cooking apparatus, the combustion device comprising a combustion assembly, the combustion assembly comprising a first combustion assembly, and the first combustion assembly comprising:

a box, which is provided with an opening and a set of intake holes;

a first combustor, which is arranged in the box;

a top plate, which is matched with the box and closes the opening, and which is provided with a set of exhaust holes; and a fire splitting assembly, which is arranged in the box; wherein an intake passage is formed between the fire splitting assembly and an inner bottom surface of the box, a first end of the intake passage communicates with the set of intake holes, and a second end of the intake passage communicates with an installation position of the first combustor; and wherein an exhaust passage is formed between the fire splitting assembly and the top plate, a first end of the exhaust passage communicates with the set of exhaust holes, and a second end of the exhaust passage communicates with the installation position of the first combustor;

wherein the set of intake holes comprise a first intake hole, the set of exhaust holes comprise a first exhaust hole, and the fire splitting assembly comprises a first fire splitting plate; wherein the first fire splitting plate, the first exhaust hole and the first intake hole are all located on one side of the first combustor; a first passage portion of the exhaust passage is formed between the first fire splitting plate and the top plate; the first and second ends of the first passage portion communicate with the first exhaust hole and the installation position of the first combustor respectively; and wherein a first passage section of the intake passage is formed between the first fire splitting plate and the inner bottom surface of the box, and the first and second ends of the first passage section communicate with the first intake hole and the installation position of the first combustor respectively.

2. The combustion device according to claim 1, wherein the first fire splitting plate comprises:

a first plate body portion, which is arranged spaced apart from the inner bottom surface of the box, wherein a first end of the first plate body portion abuts against the top plate, and a second end of the first plate body portion extends toward the installation position of the first combustor; and a first support portion, wherein the first plate body portion is matched with the inner bottom surface of the box through the first support portion, wherein an edge of the first plate body portion abuts against a side wall of the box; and/or the first plate body portion is of a first bend structure.

3. The combustion device according to claim 1, wherein the first exhaust hole is a first elongated hole, and the first elongated hole extends in a length direction of the first combustor; and/or the number of the first intake holes is plural, and each of the first intake holes is provided on a side wall of the box and/or the inner bottom surface of the box.

4. The combustion device according to claim 1, wherein the set of intake holes comprise a second intake hole, the set of exhaust holes comprise a second exhaust hole, and the fire splitting assembly comprises a second fire splitting plate; wherein the second fire splitting plate, the second exhaust hole and the second intake hole are all located on the other side of the first combustor; a second passage portion of the exhaust passage is formed between the second fire splitting plate and the top plate; the first and second ends of the second passage portion communicate with the second exhaust hole and the installation position of the first combustor respectively; a second passage section of the intake passage is formed between the second fire splitting plate and the inner bottom surface of the box, and the first and second ends of the second passage section communicate with the second intake hole and the installation position of the first combustor respectively.

5. The combustion device according to claim 4, wherein the second fire splitting plate comprises:

a second plate body portion, which is arranged spaced apart from the inner bottom surface of the box, wherein a first end of the second plate body portion abuts against the top plate, and a second end of the second plate body portion extends toward the installation position of the first combustor; and a second support portion, wherein the second plate body portion is matched with the inner bottom surface of the box through the second support portion, wherein an edge of the second plate body portion abuts against a side wall of the box; and/or the second plate body portion is of a second bend structure.

6. The combustion device according to claim 4, wherein the second exhaust hole is a second elongated hole, and the second elongated hole extends in a length direction of the first combustor; and/or the number of the second intake holes is plural, and each of the second intake holes is provided on a side wall of the box and/or the inner bottom surface of the box.

7. The combustion device according to claim 1, wherein the combustion assembly further comprises a second combustion assembly, and the second combustion assembly comprises:

a second combustor, which is arranged in a cooking cavity of the cooking apparatus and is configured to heat the cooking cavity; and a radiation plate, which is arranged between the second combustor and a top plate of the cooking cavity; wherein the radiation plate is a bend plate and extends in a length direction of the cooking cavity, and flames of the second combustor flow along a side surface of the radiation plate that is away from the top plate of the cooking cavity.

8. The combustion device according to claim 7, wherein the radiation plate comprises:

a main plate body, which is arranged spaced apart from the top plate of the cooking cavity; wherein the second combustor is located on a side of the main plate body that is away from the top plate of the cooking cavity and is matched with the main plate body;

a first plate body, which is of a first bend structure and is connected to one side of the main plate body; and a second plate body, which is of a second bend structure and is connected to the other side of the main plate body, wherein the first plate body comprises:

a first portion, which is connected to the one side of the main plate body and is arranged in a direction approaching the top plate of the cooking cavity; and a second portion, which is connected to the first portion and bends in a direction away from the top plate of the cooking cavity, wherein a first connection structure is provided on the second portion, and the first connection structure is configured to connect with the top plate of the cooking cavity.

9. The combustion device according to claim 8, wherein the number of the first connection structures is plural, and the first connection structures are arranged spaced apart on the second portion; and/or an edge of the second portion that is away from the first portion is provided with a first cut toward an inner side of the second portion, and materials removed at the position of the first cut bend in the direction approaching the top plate of the cooking cavity to form the first connection structure; and/or a first corner position of the second portion is provided with a first round chamfer, and the first corner position is away from the first portion and close to an open end of the cooking cavity.

10. The combustion device according to claim 8, wherein the second plate body comprises:

a third portion, which is connected to the other side of the main plate body and is arranged in a direction approaching the top plate of the cooking cavity; and a fourth portion, which is connected to the third portion and bends in a direction away from the top plate of the cooking cavity, wherein a plurality of second connection structures are provided on the fourth portion, and the second connection structures are is configured to connect with the top plate of the cooking cavity, and the second connection structures are arranged spaced apart on the fourth portion; and/or an edge of the fourth portion that is away from the third portion is provided with a second cut toward an inner side of the fourth portion, and materials removed at the position of the second cut bend in the direction approaching the top plate of the cooking cavity to form the second connection structure; and/or a second corner position of the fourth portion is provided with a second round chamfer, and the second corner position is away from the third portion and close to an open end of the cooking cavity.

11. The combustion device according to claim 8, wherein an installation groove is provided on the main plate body, an installation structure is provided on the second combustor, and the installation structure is adapted to be installed in the installation groove; and/or the combustion assembly further comprises fasteners, and the second combustor is connected to the main plate body through the fasteners.

12. The combustion device according to claim 7, wherein the combustion device further comprises a combustion inductor arranged on the combustion assembly, and the combustion inductor comprises an inductor body and a wiring terminal that are detachably connected.

13. The combustion device according to claim 12, wherein the inductor body is arranged at a first end of the combustion assembly, and the wiring terminal is arranged at a first end of the inductor body that is away from the combustion assembly, wherein a part of the wiring terminal that is close to the inductor body is provided with a snap-fit structure, and the snap-fit structure is snap-fitted with the inductor body so that the snap-fit structure and the inductor body are electrically conducted with each other, wherein a wiring hole is provided at a first end of the wiring terminal that is away from the inductor body, wherein at least part of an outer surface of the wiring terminal is provided with an insulating layer, wherein at least part of the inductor body is of a rod-shaped structure, wherein an induction probe is provided at a first end of the inductor body that faces the combustion assembly, wherein the combustion inductor further comprises a connection bracket, the connection bracket is connected to the inductor body, and the connection bracket protrudes outward in a radial direction of the inductor body and is configured to connect with the combustion assembly, wherein a strength of the wiring terminal is greater than a strength of the inductor body.

14. The combustion device according to claim 12, wherein the combustion inductor is arranged on a fire row of the second combustor at a position near an intake end, and the combustion inductor is arranged in an axial direction of the fire row.

15. The combustion device according to claim 14, wherein the combustion assembly further comprises a fixing bracket connected to the fire row at a position near the intake end, the fixing bracket is provided with a first installation plate, and the first installation plate extends toward one side in a radial direction of the fire row; and wherein a third connection structure is provided on the first installation plate, and the combustion inductor is detachably connected to the first installation plate through the third connection structure.

16. The combustion device according to claim 15, wherein the third connection structure is arranged toward the axial direction of the fire row.

17. The combustion device according to claim 15, wherein a second installation plate is provided on a side of the fixing bracket that is opposite to the first installation plate, and the second installation plate is provided with a fourth connection structure for connecting with an igniter.

18. The combustion device according to claim 12, wherein the combustion inductor is an ion inductor.

19. A cooking apparatus, comprising:

a cabinet, which is provided with a cooking cavity;

a door, which is pivotally connected to the cabinet to open or close the cooking cavity;

a combustion device according to claim 1; wherein the combustion device is arranged in the cooking cavity and is configured to heat the cooking cavity, and an axial direction of the combustion assembly of the combustion device is opposite to the door;

an igniter, which is detachably connected to the combustion assembly; and an electronic control assembly, which is electrically connected to a combustion inductor of the combustion device and the igniter, respectively.

* * * * *